US007531281B2

(12) United States Patent
Tomita et al.

(10) Patent No.: US 7,531,281 B2
(45) Date of Patent: May 12, 2009

(54) TONER FOR DEVELOPING LATENT ELECTROSTATIC IMAGE, CONTAINER HAVING THE SAME, DEVELOPER USING THE SAME, PROCESS FOR DEVELOPING USING THE SAME, IMAGE-FORMING PROCESS USING THE SAME, IMAGE-FORMING APPARATUS USING THE SAME, AND IMAGE-FORMING PROCESS CARTRIDGE USING THE SAME

(75) Inventors: Masami Tomita, Shizuoka (JP); Tadao Takikawa, Aichi (JP); Tomoyuki Ichikawa, Shizuoka (JP); Fumihiro Sasaki, Shizuoka (JP); Toshiki Nanya, Shizuoka (JP); Hiroto Higuchi, Shizuoka (JP); Shigeru Emoto, Shizuoka (JP); Shinichiro Yagi, Shizuoka (JP); Naohito Shimota, Shizuoka (JP); Maiko Kondo, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 11/980,488

(22) Filed: Oct. 31, 2007

(65) Prior Publication Data

US 2008/0138735 A1 Jun. 12, 2008

Related U.S. Application Data

(60) Division of application No. 11/298,583, filed on Dec. 12, 2005, now Pat. No. 7,384,720, which is a continuation of application No. 10/607,014, filed on Jun. 27, 2003, now Pat. No. 7,157,201.

(30) Foreign Application Priority Data

Jun. 28, 2002 (JP) ..... 2002-190465
Sep. 17, 2002 (JP) ..... 2002-269845

(51) Int. Cl.
*G03G 9/087* (2006.01)

(52) U.S. Cl. ..... 430/110.4; 430/137.21

(58) Field of Classification Search ..... 430/111.3, 430/109.4, 110.4, 137.21
See application file for complete search history.

(56) References Cited

U.S. PATENT DOCUMENTS 5,712,070 A 1/1998 Nozawa et al.

(Continued)

FOREIGN PATENT DOCUMENTS

EP 1 030 229 A2 8/2000

(Continued)

*Primary Examiner*—John L Goodrow
(74) *Attorney, Agent, or Firm*—Oblon, Spivak, McClelland, Maier & Neustadt, P.C.

(57) ABSTRACT

A toner for developing a latent electrostatic image including a base of toner particle which contains a binder resin and a coloring agent, and an external additive. Herein, a plurality of the base of toner particle has a volume average particle diameter (Dv) of 3 μm to 7 μm, a ratio (Dv/Dn) of the volume average particle diameter (Dv) to a number average particle diameter (Dn) is 1.01 to 1.25, a plurality of the base of toner particle contains 15% by number or less of the base of toner particle having a particle diameter of 0.6 μm to 2.0 μm, a plurality of the base of toner particle has a circularity of 0.930 to 0.990 on average, the binder resin contains a modified polyester resin, and the toner contains 0.3 parts by weight to 5.0 parts by weight of the external additive, relative to 100 parts by weight of the base of toner particle.

9 Claims, 12 Drawing Sheets

U.S. PATENT DOCUMENTS

| | | | | |
|---|---|---|---|---|
| 5,885,743 | A | 3/1999 | Takayanagi et al. | |
| 6,326,115 | B1 | 12/2001 | Nakanishi et al. | |
| 6,660,443 | B2 | 12/2003 | Sugiyama et al. | |
| 6,682,866 | B2 | 1/2004 | Sugiyama et al. | |
| 6,699,632 | B2 | 3/2004 | Higuchi et al. | |
| 6,740,460 | B2 | 5/2004 | Tomita et al. | |
| 6,787,280 | B2 | 9/2004 | Yamashita et al. | |
| 6,800,412 | B2 | 10/2004 | Sugiyama et al. | |
| 6,824,945 | B2 * | 11/2004 | Emoto et al. | 430/137.15 |
| 6,835,519 | B2 | 12/2004 | Sugiyama et al. | |
| 6,849,369 | B2 * | 2/2005 | Yagi et al. | 430/110.4 |
| 6,852,462 | B2 | 2/2005 | Emoto et al. | |
| 6,936,390 | B2 | 8/2005 | Nanya et al. | |
| 2003/0055159 | A1 | 3/2003 | Yamashita et al. | |
| 2003/0096185 | A1 | 5/2003 | Yamashita et al. | |
| 2003/0134220 | A1 | 7/2003 | Emoto et al. | |
| 2004/0106057 | A1 | 6/2004 | Tomita et al. | |
| 2004/0131961 | A1 | 7/2004 | Watanabe et al. | |
| 2004/0142265 | A1 | 7/2004 | Tomita et al. | |
| 2004/0157146 | A1 | 8/2004 | Tomita et al. | |
| 2005/0112488 | A1 | 5/2005 | Yamada et al. | |
| 2005/0250036 | A1 | 11/2005 | Emoto et al. | |

FOREIGN PATENT DOCUMENTS

| | | |
|---|---|---|
| EP | 1 026 554 | 9/2000 |
| EP | 1 296194 | 3/2003 |
| EP | 1 030 299 B1 | 10/2006 |
| JP | 57-109825 | 7/1982 |
| JP | 05-142850 | 6/1993 |
| JP | 7-56390 | 3/1995 |
| JP | 07-092731 | 4/1995 |
| JP | 7-10131 8 | 11/1995 |
| JP | 9-34167 | 2/1997 |
| JP | 9-43909 | 2/1997 |
| JP | 10-111582 | 4/1998 |
| JP | 10-142838 | 5/1998 |
| JP | 11-125931 | 5/1999 |
| JP | 11-133665 | 5/1999 |
| JP | 11-133666 | 5/1999 |
| JP | 11-149180 | 6/1999 |
| JP | 2000-305360 | 11/2000 |
| JP | 2001-318477 | 11/2001 |
| JP | 2002-169336 | 6/2002 |
| WO | WO 01/60893 | 8/2001 |

* cited by examiner

TONER FOR DEVELOPING LATENT ELECTROSTATIC IMAGE, CONTAINER HAVING THE SAME, DEVELOPER USING THE SAME, PROCESS FOR DEVELOPING USING THE SAME, IMAGE-FORMING PROCESS USING THE SAME, IMAGE-FORMING APPARATUS USING THE SAME, AND IMAGE-FORMING PROCESS CARTRIDGE USING THE SAME

CROSS-REFERENCE TO RELATED APPLICATIONS

This application is a divisional application of Ser. No. 11/298,583, filed Dec. 12, 2005, now U.S. Pat. No. 7,384,720 which is a continuation application of Ser. No. 10/607,014, filed Jun. 27, 2003, now U.S. Pat. No. 7,157,201 and claims the benefit of priority from the prior Japanese Patent Application No. 2002-190465, filed Jun. 28, 2002, and Japanese Patent Application No. 2002-269845, filed Sep. 17, 2002.

BACKGROUND OF THE INVENTION

1. Field of the Invention

The present invention relates to a toner for developing electrostatic images in electrophotography, electrostatic recording or electrostatic printing, to a developer which comprises the toner, and to an image-forming process and image-forming apparatus using the developer which comprises the toner. More specifically, the present invention relates to a toner for developing an electrostatic image used in copiers, laser printers and fax machines that utilize plain paper using direct or indirect electrophotographic developing process, to developer which comprises the toner, and to an image-forming process and an image-forming apparatus using the developer which comprises the toner. It further relates to a toner for developing an electrostatic image used in full color copiers, full color laser printers and full color fax machines that utilize plain paper using the direct or indirect electrophotographic multicolor image-forming process, to a developer which comprises the toner, and to a image-forming process, a developing device (image-developer), an image-forming process and image-forming apparatus using the developer containing the toner.

2. Description of the Related Art

In a developing step, a developer used in electrophotography, electrostatic recording, electrostatic printing or the like, is first adhered to an image-bearing member such as a photoconductor on which a latent electrostatic image is formed. In a transferring step, the developer is then transferred from the photoconductor to a transferring medium such as a transfer paper, and is then fixed in an image-fixing step. In this procedure, the developer for developing an electrostatic image formed on the image-bearing surface of the transfer paper, may be a double-component developer comprising a carrier and a toner, or a single-component developer (magnetic toner/non-magnetic toner) which does not need a carrier.

Conventionally, dry toners used for electrophotography, electrostatic recording and electrostatic printing, are obtained by melt kneading a binder resin such as a styrene resin or a polyester resin with a coloring agent, and then pulverizing.

(Problems in Image-fixing)

After these dry toners are developed and transferred onto paper, or the like, the dry toners are fixed by heat fusion using a heating roller. If the temperature of the heating roller is too high, hot offset may occur in which excessive amount of toners become melted and stuck to the heating roller. Conversely, if the temperature of the heating roller is too low, the toners do not melt properly and thus image-fixing is poor. From the viewpoint of energy saving and size reduction of apparatus such as copiers or the like, a toner is desired to have higher offset temperature (heat-resistance offset property), and low image-fixing temperature (low temperature image-fixing properties). Moreover, storage heat resistance is required in which the toner does not block during storage and under the temperature conditions of the equipment used.

In full color copiers and full color printers, image glossiness and color mixing properties are required and the toner particularly needs to have a low melt viscosity. A sharp metal polyester binder resin has been therefore used. With such a toner, hot offset easily occurs, in the full color devices of the related art, the heating roller has been therefore coated with silicone oil. However, the process of applying the silicone oil to the heating roller requires an oil tank and oil coating equipment, which makes the apparatus complex and bigger. It has also led to deterioration of the heating roller and the need for maintenance has to be carried out periodically. Furthermore, adhesion of oil to copy papers or OHP (overhead projectors) film cannot be avoided. In OHP, particularly, there is a problem of poor color tone due to oil adhesion.

(Particle Diameter and Problems of Formation)

In order to obtain high image quality and high appearance quality, improvement has been made by making the particle diameter small, but with the usual manufacturing process of kneading and pulverizing, the particle formation is not defined. Inside the apparatus, the toner is stirred with the carrier in the developing part. In the case of a single-component developer, toner is further pulverized by contact stress with the development roller, the toner supplying roller, the layer thickness adjusting blade and the frictional charge blade. This produces submicron particles or results in having fluidizers embedded on the toner surface. An image quality therefore deteriorates. Also, due to the formation and poor fluidity (fluidability) of the toner as powder, the toner is required to be more fluidized, less of the toner is filled in the toner bottle, and it is therefore difficult to make the apparatus smaller.

In order to produce full color images, the transfer of multicolor toner from the photoconductor onto a transferring medium or paper is also complicated. Due to poor transfer properties resulting from the non-defined particle formation of the pulverized toner, there are problems that image dropout occurs, that more toner is required to cover the dropout, and the like.

Therefore, there has been an increasing demand on reducing the toner consumption by further improvement of transfer efficiency, to obtain high-quality images without image dropout, and to reduce running costs. If the transfer efficiency is very high, there is no need for a cleaning unit for removing non-transferred toner from the photoconductor or a transferring medium, and a smaller-sized apparatus can be attained as well as low cost. This also has the advantage that there would be no discarded toner. Thus, various processes have been developed to manufacture spherical toner, in order to compensate the disadvantages of toner having non-defined formation.

To achieve heat-resistant storage properties, low temperature image-fixing properties and hot offset-resistance properties, (1) a polyester resin partially crosslinked using a polyfunctional monomer Japanese Patent Application-Laid-Open GP-A) No 57-109825), (2) a urethane-modified polyester resin Japanese Patent Application Publication OP-B) No. 07-101318), and the like have been disclosed as binder resins. In addition, (3) toner obtained by granulating polyester resin fine particles and wax fine particles, has been disclosed to reduce the oil coating amount on heating rollers for full color image-forming (JP-A No. 07-56390).

To improve powder fluidity and transfer properties in the case of small particle diameter, there have been disclosed (4) a polymerized toner obtained by suspension polymerization of a vinyl monomer composition which contains a coloring agent, polar resin and release agent and is dispersed in water before the suspension polymerization (JP-A No. 09-43909), and (5) a toner comprised of a polyester resin having a spherical formation, using a solvent (JP-A No. 09-34167).

Furthermore, JP-A No. 11-133666, discloses (6) a substantially spherical toner that utilizes a polyester resin modified by urea bonds.

However, the toners disclosed in (1) to (3) all have poor powder fluidity and transfer properties, and decreasing the particle diameter does not allow high quality images. Further, regarding the toners of (1) and (2), heat storage properties and low temperature image-fixing properties cannot be obtained at the same time, and glossiness cannot be obtained with full color, so they were not practical. Regarding the toner of (3), low temperature image-fixing properties are inadequate and hot offset properties in oil-less image-fixing are unsatisfactory. The toners of (4) and (5) do have improved powder fluidity and transfer properties, however, for the toner of (4), low temperature image-fixing properties are poor and a large amount of energy was required for image-fixing. These problems are particularly evident for full color toners. For the toner of (5), low temperature image-fixing properties are much better, however, hot offset resistance is poor and when used for full color, oil coating of the heating roller cannot be dispensed with.

The toner of (6) has a viscoelasticity which can be suitably adjusted using a polyester resin extended by urea bonds, and it is thus excellent in the fact that suitable glossiness and mold release properties could both be realized, when used as a full color toner. In particular, an electrostatic offset, in which the image-fixing roller is charged, toners on a non-fixed image are electrostatically distributed, and toners adhere to the fixing roller, can be mitigated by the positive charge of the urea bond component and the weak negative charge of the polyester resin. However, despite these advantages, when the toners are actually used, the toners become more finely pulverized by mixing with the carriers in the developing part of the apparatus, and when used as a single-component developer, by contact stress due to the development roller, the toner supplying roller, the layer thickness adjusting blade and frictional charge blade, and produces particles. As the fluidizer becomes embedded in the toner surface, image quality tends to deteriorate, and the life of toner is thereby shortened.

(Problems of Image-Forming Process)

The above image deterioration with time is particularly remarkable when an image-forming process is used to increase magnetic brush density so as to prevent abnormal images such as "image omission at rear end."

In general, in image-forming apparatuses for electrophotography or image-forming apparatuses for electrostatics such as copiers, printers and facsimile, and electrostatic recording image-forming apparatus, a latent electrostatic image corresponding to image information is first formed on a latent image-bearing member such as a photoconducting drum, photoconducting belt, or the like and then developed by a developing device to obtain a visible image. During this developing process, from the viewpoint of stability of development properties regarding transfer, half-tone reproducibility and temperature/humidity, an image-forming process employing a magnetic brush using a double-component developer which comprises a toner and a carrier, is generally utilized. In the other words, in this developing device, the double-component developer forms a brush chain on the developer bearing member, and in the developing region, toners in the developer are supplied to the latent image part on the latent image-bearing member. Here, developing region refers to a region where the magnetic brush are formed on the developer bearing member, and comes in contact with the latent image-bearing member.

The developer bearing member usually comprises a sleeve (development sleeve) formed in a cylindrical shape, and a magnet (magnetic roller) which generates a magnetic field to form the magnetic brush on the sleeve surface, is fitted inside the sleeve. In this process, the carriers form a magnetic brush on the sleeve along the magnetic force lines produced by the magnetic roller, and charged toners adheres to the carrier in the magnetic brushes. The magnetic roller comprises plural poles, and the magnets that generate these poles are arranged like rods. In particular, in the developing region on the sleeve surface, there is a developing main magnetic pole which forms the magnetic brushes. The developer forming the magnetic brushes on the sleeve surface can be moved by moving at least one of the sleeve and the magnetic roller. A developer transported to the developing region stands upwards so as to form magnetic brushes, along with the line of magnetic force generated by the developing main magnetic pole, the developer provided along with the line of magnetic force like a chain, comes in contact with the latent image-bearing member surface, so that it bends, and toners are supplied while brushing the latent electrostatic image based on the relative linear velocity difference between the developer brush in contact and the latent image-bearing member.

Conventionally, in this double-component developing process, developing conditions which allows sufficient image density are not compatible with those which allow low contrast images. It has been hence difficult to simultaneously improve high density parts and low density parts. The developing conditions which increase image density include (i) narrowing of the developing gap, which is the distance between the latent image-bearing member and a development sleeve, and (ii) widening of the developing region. On the other hand, the developing conditions which allow a low contrast image include (i) widening of the developing gap, and (ii') narrowing of the developing region. In other words, these two sets of developing conditions are contradictory from each other, and are not compatible. Therefore, it is generally considered difficult to obtain a high quality image satisfying both sets of developing conditions over the whole range of the density. For example, if it is desired to emphasize low contrast images, an "image omission at rear end" where some image is missing from the back of a solid fill line cross part, black solid fill or half-tone solid fill image, often occurs. FIG. 1A shows an example of a fine solid image, and FIG. 1B shows an example of image omission at rear end. Also, some horizontal lines are thinner than vertical lines in a grid image formed with the same width, and small point images of one dot are not developed.

It is considered that this "image omission at rear end" occurs by the following mechanism.

First, referring into FIG. 2, the mechanism of an image-forming process using magnetic brushes formed of a double-component developer, will be described. FIG. 2 shows an example of a negative-positive developing region, which shows an example of the above-mentioned image-forming process. In FIG. 2, the development roller which serves as a developer-bearing member is shown on the right-hand side, and the photoconductor P which serves as the latent electrostatic image-bearing member is shown on the left-hand side. The development roller comprises a development sleeve which moves in a direction D, and a development magnet fixed therein. Due to the movement of the development sleeve, the double-component developer comprising a non-magnetic toner and a magnetic carrier, is transported in a vicinity of a part adjacent to the photoconductor. When the double-component developer reaches the vicinity of the part adjacent to the photoconductor P, the carrier stands upwards and forms a magnetic brush due to the magnetic force of the magnetic pole for development. In FIG. 2, small dots express toners, and large dots express carriers. For simplicity, only one magnetic brush is shown by solid lines in the part adjacent to the photoconductor P. Herein, the remaining magnetic brushes are shown by dotted lines and the toners are omitted from the figure.

At the same time, the photoconductor rotates in the direction C while having the latent electrostatic image on a surface thereof. In FIG. 2, in the latent electrostatic image, a non-imaging part is charged negatively as shown by "A." At the part where the photoconductor faces the development roller, the magnetic brushes are contacted onto a latent image on the photoconductor, and the toners are disposed on the latent image by development electric field. As a result, a toner image is formed in the developing part of the latent image on the photoconductor downstream of the developing part as shown by B. Hereinafter, the length over which the magnetic brush contacts the photoconductor along a surface of the photoconductor in the direction that the photoconductor moves will be referred to as the development nip. It should be noted that, if only one point of the developer-bearing member contacts one point of the photoconductor, a sufficient image density cannot be obtained, hence a speed difference is generally allowed between the photoconductor and development sleeve so that a certain area of the developer-bearing member contacts one point on the photoconductor. The development sleeve therefore moves earlier than the photoconductor.

The mechanism whereby the image omission at rear end shown in FIG. 3 will now be described, referring the image-forming process using the double-component developer shown in FIG. 2 as to an example. FIGS. 3A through 3C each show examples of enlargements of the part adjacent to the photoconductor and the development sleeve in FIG. 2. In the FIGS. 3A through 3C, the tip of the magnetic brush shown on the right-hand side of the figures approaches the photoconductor shown on the left-hand side. FIGS. 3A through 3C each show the movement of the magnetic brush in time series, starting from FIG. 3A. In FIGS. 3A through 3C, the part adjacent to the photoconductor and the development roller is in the step of developing the boundary between the non-imaging part and a black solid image, i.e., the state in which the "image omission at rear end" appears, and the toner image which has just been developed is formed downstream of a direction that the photoconductor rotates. One of the magnetic brushes on the development sleeve is approaching the photoconductor in this state. Here, the photoconductor rotates clockwise, and as the development sleeve moves earlier than the photoconductor as described the above, the magnetic brush catches up with and passes the photoconductor. Therefore, in FIGS. 3A through 3C, the photoconductor is depicted as stationary to simplify the model. In FIG. 3A, the magnetic brush which approaches the photoconductor passes through a non-imaging part up to a point E, which is to be developed, and due to a repulsion F between negative charges, toners gradually leave the photoconductor and moves towards the development sleeve.

This phenomenon is referred to hereafter as "toner drift." As a result of the toner drift, when the magnetic brush reaches the point E, the magnetic brush adjacent to the photoconductor have the positively-charged carriers directly present as shown in FIG. 3B. As a result, there is no toner disposing on the latent image at the point E, and the point E is not developed. Also, when the magnetic brush reaches the point G in FIG. 3C, if the disposing force between the toner and photoconductor is weak, toner which once disposed on the photoconductor may be disposed again to the carrier due to electrostatic force. As a result, at the boundary between the image part and non-imaging part, developing does not take place and this causes the "image omission at rear end."

The mechanism of image omission at rear end has been described referring to one cross-section of the part adjacent to the development roller and photoconductor. However, in practice, when the magnetic brushes contacts the photoconductor in the longitudinal direction of the development roller, the length of the magnetic brush is not the same among the magnetic brushes, and magnetic brushes have different size, depending on the position in the longitudinal direction of the development roller. FIG. 4 shows this situation. FIGS. 4A and 4B each schematically shows an example of the state of the magnetic brush when the photoconductor is not present. FIG. 4A shows a magnetic brushes present on the development roller in the longitudinal direction. FIG. 4B shows an example of a cross-section of the magnetic brush in FIG. 4A taken along a plane H-H' perpendicular to the longitudinal direction. In other words, FIG. 4B is a view which shows the magnetic brush in the same cross-section as that of FIG. 2. In order to clarify the relation with other drawings, FIG. 4A schematically shows the positional relationship with the photoconductor. As shown in FIG. 4A, there is a large distribution in height of the magnetic brushes present in the longitudinal direction. This means that the magnetic brushes contact the latent image-bearing member irregularly in the longitudinal direction. As a result, there is also distribution as regards the degree of toner drift in the longitudinal direction and the degree of "image omission at rear end" in the longitudinal direction are not fixed either, hence, a zigzag image omission at rear end appears in the longitudinal direction of the development roller, as shown in FIGS. 1A and 1B.

Due to a similar mechanism, horizontal lines are thinner than vertical lines (horizontal line thinning) and the formation of isolated dots is unstable, which makes it difficult to obtain high image quality by the development using magnetic brushes formed of a double-component developer.

An effective way of preventing abnormal images such as "image omission at rear end," and obtaining a high-quality image with good horizontal line and dot reproducibility without edge influence, is to arrange the developing device so that, in the development nip region where the magnetic brush on the development sleeve contacts the photoconductor during developing, the development nip region is narrowed. The principle of this is that, if the nip in the developing part is made narrower, the time for which the magnetic brush contacts the non-imaging part is short, which is considered to reduce the toner drift.

FIGS. 5A through 5C each show the above situation. FIGS. 5A through 5C are each a view showing an example of development when the nip in FIGS. 3A through 3C is narrowed. Specifically, in FIG. 5, unlike the case of FIGS. 3A through 3C, the magnetic brush contacts the photoconductor in a shorter time so that toner drift is reduced, in FIG. 5B, as toner drift is reduced, toners are applied to the position E, and in FIG. 5C, toners on the photoconductor are not disposed again on the carriers, because the carriers are not directly present. For this reason, image omission at rear end can be reduced. To narrow the nip, it is effective to decrease the half-value width of the magnetic pole for development. Herein, the half-value width is a value of the angular width of a part showing half of the maximum normal magnetic force (peak) of the magnetic force distribution curve in the normal direction of the magnetic pole for development. For example, if the maximum normal magnetic force of a magnet formed by the N pole is 120 MT, this is an angular width of a part showing a value of 60 mT.

However, it is known that the image omission at rear end cannot be completely suppressed merely by decreasing the half-value width of the magnetic pole for development. It is assumingly because that the nip cannot be narrowed at all positions in the longitudinal direction. Specifically, as shown in FIGS. 4A and 4B, there is usually some distribution in the height of the magnetic brushes present in the longitudinal direction, and if there is a part where long magnetic brushes are present in the longitudinal direction, the nip cannot be narrowed in this part, so toner drift cannot be avoided. To deal with this problem, it has been disclosed and applied to suitably position the magnet forming the magnetic pole in the development sleeve so that the magnetic flux density in the development nip is in the dense direction, or the attenuation factor of magnetic flux density in the normal direction in the developing main magnetic pole is above a specific value, and image omission at rear end is not severe (refer to, for example, Japanese Patent Application Laid-Open UP-A) No. 2000-305360).

In such a developing device (image-developer), in the nip region where the magnetic brush contacts the latent image-bearing member, the magnetic brush is formed with a uniform density in the longitudinal direction, so distribution in the height of the magnetic brushes in the longitudinal direction can be prevented.

The prevention of distribution in the height of the magnetic brushes in the longitudinal direction by densely forming the magnetic brush, is shown in FIGS. 6A and 6B. FIG. 6A shows an example of magnetic brushes formed densely, and FIG. 6B shows an example of magnetic brushes formed with the distribution of height. In FIG. 6A, the magnetic brushes are formed densely, so the distribution in the height of the magnetic brush in the longitudinal direction is decreased, and as a result, an image without "image omission at rear end" can be obtained as shown in FIG. 6A. On the other hand, FIG. 6B shows an example of the magnetic brushes in the related art that have distribution in the height. If the magnetic brushes as shown in FIG. 6B are used, "image omission at rear end" occurs as shown therein. Hence, if the magnetic brushes are formed with sufficient density upon reaching the nip, distribution in the height of the magnetic brush in the longitudinal direction is reduced, and as the magnetic brushes enter the nip in a sufficiently uniform state in the longitudinal direction, toner drift at various positions in the longitudinal direction can be reduced, and the occurrence of "image omission at rear end" at various positions in the longitudinal direction is sufficiently reduced.

Herein, to form the magnetic brush densely, the attenuation factor of the normal magnetic flux density of the magnetic pole for development forming the magnetic brush may be increased. The attenuation factor of the normal magnetic flux density of the magnetic pole for development is a value obtained by: $(x-y)+x\times100\%$, which expresses how much the normal magnetic flux density "y" is attenuated in a 1 mm distant part from a surface of the development roller relative to the normal magnetic flux density "x" of the surface of the development roller. For example, when the normal magnetic flux density of the surface of the development roller is 100 mT and the normal magnetic flux density in a 1 mm distant part from the surface of the development roller is 80 mT, the attenuation factor is 20%. The normal magnetic flux density is measured by for example a Gauss meter (HGM-8300: produced by ADS (Application & Data System, Inc.)) and an A1 axial probe (produced by ADS (Application & Data System, Inc.)). It has previously been disclosed that if the attenuation factor of the normal magnetic flux density of the main magnetic pole which generates the brush in the developing region is 40% or more, and preferably 50% or more, a magnetic brush having more density is formed, and the more the distribution in the height of the magnetic brushes in the longitudinal direction can be reduced (refer to, for example, JP-A No 2000-305360). According to the present invention, as an attenuation factor within this range is effective, a developing device which realizes this attenuation factor is used.

The reason why the magnetic brushes become denser when the attenuation factor increases, is considered to be that when the attenuation factor is high, the magnetic force sharply decreases with increasing distance from the development roller, so the magnetic force at the tip of magnetic brushes becomes too weak to maintain the magnetic brush, and carrier at the magnetic brush tip is attracted to the surface of the development roller where the magnetic force is strong. The attenuation factor can be increased by selecting the material for magnet which forms a magnetic pole for development, or by concentrating the magnetic force lines leaving the magnetic pole for development. Of these methods, the magnetic force lines leaving the magnetic pole for development can be concentrated for example by forming the magnetic pole for development from a main magnetic pole which forms the magnetic brushes, and auxiliary magnetic poles having opposite polarity to the main magnetic pole disposed upstream and downstream of the main magnetic pole in the direction that the developer-bearing member moves.

Another solution of concentrating the magnetic force lines leaving the magnetic pole for development, when there is an additional magnetic pole to the magnetic pole for development in the developer-bearing member, such as a transport magnetic pole, is to concentrate the majority of the magnetic force lines leaving the magnetic pole for development in the transport magnetic pole by narrowing the half-value width of the magnetic pole for development. It is preferable that this half-value width is 22° or less, and preferably 18° or less. It has been experimentally verified that this attenuation factor increases when the half-value width of the magnetic pole is narrowed.

Summarizing the above, by using a double-component magnetic brush developing device (image-developer) which has functions of: (1) magnetic brushes are formed uniformly in the longitudinal direction to come in contact with a photoconductor; (2) an auxiliary magnetic pole is formed which assists the magnetic force of the main magnetic pole for development; (3) the attenuation factor of the normal magnetic flux density of the main magnetic pole is 40% or more; and (4) the half-value width of the main magnetic pole is 22° or less, abnormal images having "image omission at rear end" can be prevented, and high image quality with sufficient image density can be achieved.

However, if the above image-forming process (1), (2), (3), and (4) which increase the magnetic brush density to prevent abnormal images that have "image omission at rear end" is employed, the developer in the development nip part has a higher contacting force (impact force) given on the photoconductor, compared to the case when the magnetic brush density is low, and a high stress is easily given on the developer (and toners contained in the developer), so the toners tend to deteriorate with time, charge is lost and toner scattering or toner deposition on background of the image tend to occur. Due to this, image deterioration with time as compared to the initial image, becomes much more apparent. In particular, when a toner having a relatively wide toner charge distribution is used, this is a very serious problem. Accordingly, when an image-forming process which increases magnetic brush density is adopted to prevent abnormal images having "image omission at rear end," it is important to prevent image deterioration with time.

SUMMARY OF THE INVENTION

It is therefore an object of the present invention to provide a toner for developing an electrostatic image having excellent powder fluidity, development properties and transfer properties together with excellent heat storage properties, low temperature image-fixing properties and hot offset properties when used as a toner having a small particle diameter, having good and stable development properties over long periods of use and which can form high-quality images, and in particular to provide a toner for developing an electrostatic image having excellent image glossiness when used in full color copiers, and having a long lifetime.

It is another object of the present invention to provide a toner container which comprises the toner for developing a latent electrostatic image of the present invention, and a developer which comprises the toner for developing a latent electrostatic image of the present invention.

It is yet another object of the present invention to provide an image-forming process using the developer of the present invention, in which, while increasing the magnetic brush density so as to give sufficient image density, abnormal images such as "image omission at rear end" at low contrast can be prevented, and images having good reproducibility of horizontal line and dot without edge effects can be obtained in a long period of time, taking the deterioration of the toner with time into consideration, and to provide an image-forming apparatus which comprises the developer of the present invention.

The inventors of the present invention, as a result of intensive studies aimed at resolving the above problems, have discovered that by giving the toners a specific particle size distribution and the specific circularity and by adding external additives in specific proportions, the above objects can be attained, and thereby have arrived at the present invention.

The present invention provides, in a first aspect, a toner for developing a latent electrostatic image which comprises a base of toner particle which comprises a binder resin and a coloring agent, and an external additive. In the toner for developing a latent electrostatic image of the present invention, a plurality of the base of toner particle has a volume average particle diameter (Dv) of 3 μm to 7 μm, a ratio (Dv/Dn) of the volume average particle diameter (Dv) to a number average particle diameter (Dn) is 1.01 to 1.25, a plurality of the base of toner particle comprises 15% by number or less of the base of toner particle having a particle diameter of 0.6 μm to 2.0 μm, a plurality of the base of toner particle has a circularity of 0.930 to 0.990 on average, the binder resin comprises a modified polyester resin, and the toner comprises 0.3 parts by weight to 5.0 parts by weight of the external additive, relative to 100 parts by weight of the base of toner particle.

The present invention provides, in another aspect, a container which comprises the toner for developing a latent electrostatic image.

The present invention provides, in another aspect, a developer which comprises the toner for developing a latent electrostatic image of the present invention.

The present invention provides, in another aspect, a process for developing which comprises the step of supplying a developer onto a latent electrostatic image, so as to visualize the latent electrostatic image. In the process for developing of the present invention, the developer comprises a toner for developing a latent electrostatic image according to the present invention.

The present invention provides, in another aspect, an image-forming process which comprises the step of charging a latent electrostatic image-bearing member imagewisely the step of irradiating light to the latent electrostatic image-bearing member, so as to-form a latent electrostatic image the step of supplying a developer onto the latent electrostatic image so as to visualize the latent electrostatic image and to form a toner image; and the step of transferring the toner image onto a recording medium. In the image-forming process of the present invention, the developer comprises a toner for developing a latent electrostatic image according to the present invention.

The present invention provides, in another aspect, an image-forming apparatus which comprises a latent electrostatic image-bearing member, a charger configured to charge the latent electrostatic image-bearing member so as to form a latent electrostatic image, a light-irradiator configured to irradiate a light to the latent electrostatic image, an image-developer configured to supply a developer onto the latent electrostatic image, so as to form a toner image, and a transfer configured to transfer the toner image onto a recording medium. In the image-forming apparatus of the present invention, the developer comprises a toner for developing a latent electrostatic image according to the present invention.

The present invention provides, in another aspect, an image-forming process cartridge which comprises a developer, an image-developer configured to have a developer container, and to supply the developer onto a latent electrostatic image, so as to visualize the latent electrostatic image and to form a toner image, and one of a latent electrostatic image support, a charger configured to charge a surface of the latent electrostatic image uniformly, and a cleaner configured to clean the surface of the latent electrostatic image support. In the image-forming process cartridge of the present invention, the image-forming process cartridge is formed in one-piece construction, and is attachable to and detachable from an image-forming apparatus, the developer comprises a toner for developing a latent electrostatic image according to the present invention.

DETAILED DESCRIPTION OF THE PREFERRED EMBODIMENTS

The present invention will now be described in further detail. A toner for developing a latent electrostatic image according to the present invention comprises a base of toner particle which comprises a binder resin and a coloring agent and an external additive. In the present invention, the "base of toner particle" refers to a toner particle to which the external additive is not yet added. In the toner for developing a latent electrostatic image of the present invention, a plurality of the base of toner particle has a volume average particle diameter (Dv) of 3 μm to 7 μm, a ratio (Dv/Dn) of the volume average particle diameter (Dv) to a number average particle diameter (Dn) is 1.01 to 1.25, a plurality of the base of toner particle comprises 15% by number or less of the base of toner particle having a particle diameter of 2.0 μm, a plurality of the base of toner particle has a circularity of 0.930 to 0.990 on average, the binder resin comprises a modified polyester resin, and the base of toner particle comprises 0.3 parts by weight to 5.0 parts by weight of the external additive, relative to 100 parts by weight of the base of toner particle. With these configurations, a developer which comprises the toner for developing a latent electrostatic image, there is not much difference of particle diameter in the developer, even if the toners are recycled over long period of time, and even if stirred for long period of time in a developing device (image-developer), good, stable development properties can be obtained. Also, when it is used as a single-component developer, there is not much difference of particle diameter even if the toner is recycled, there is no fuse of the toners on a development roller or sticking of toners to blades or other parts due to thinning of the layer of the toner, and even if used (stirred) for long period of time in a developing device (image-developer), good and stable development properties and images can be obtained.

Figure 1A:
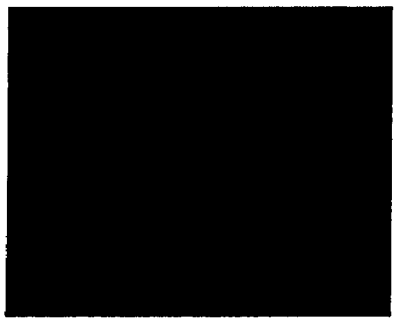
FIGS. 1A and 1B are each views showing an example of image omission at rear end.
Figure 1B:
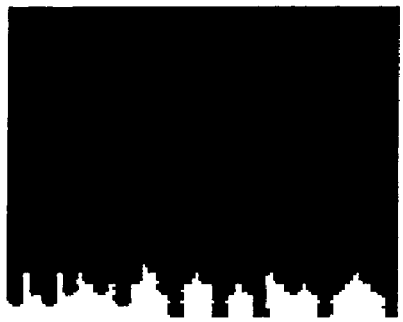
Figure 2:
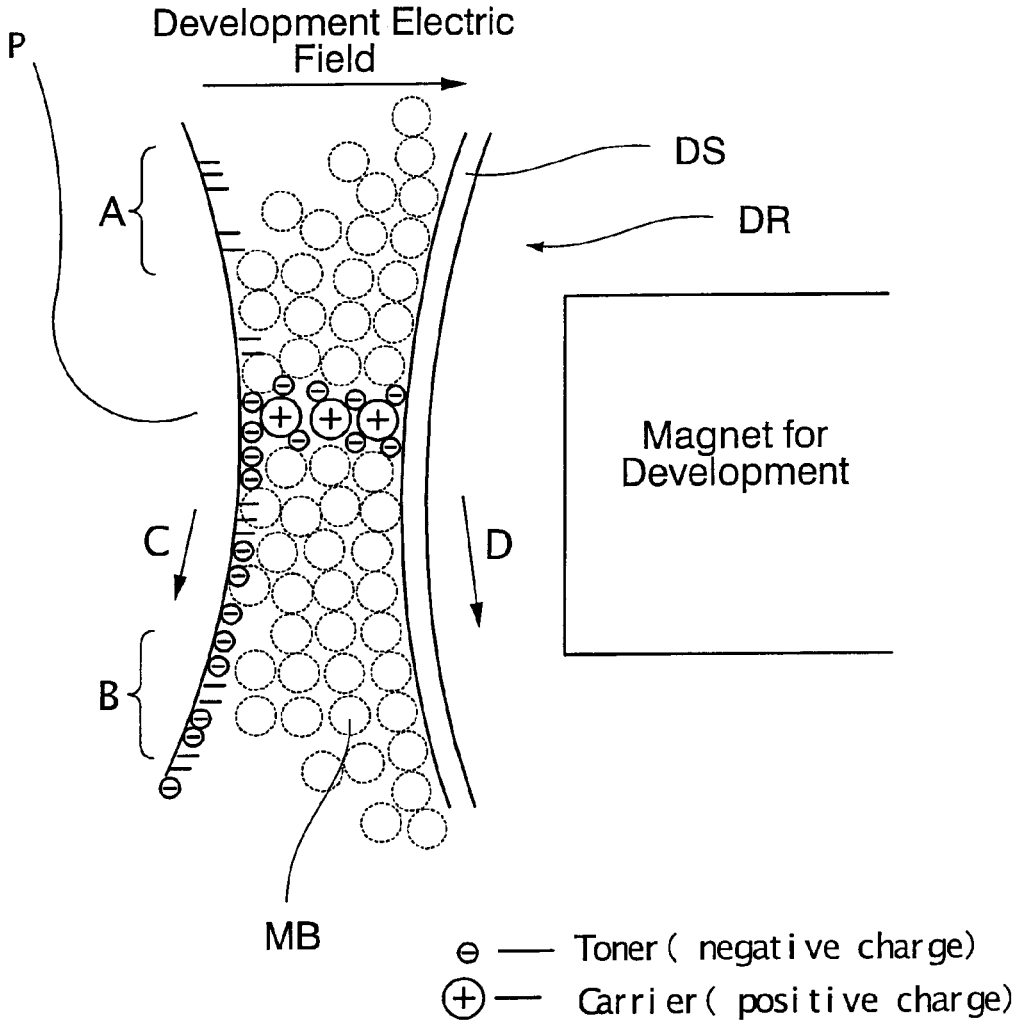
FIG. 2 is a view schematically showing an example of a developing part.
Figure 3A:
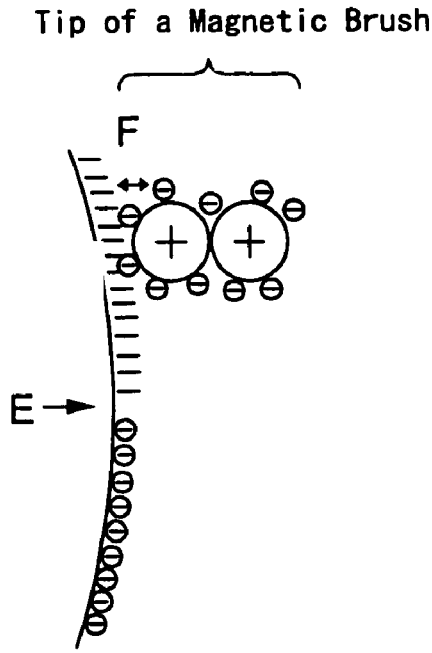
FIGS. 3A through 3C are views showing an example of the mechanism of image omission at rear end.
Figure 3B:
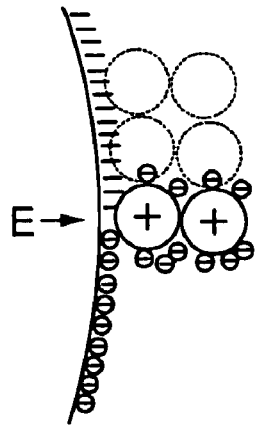
Figure 3C:
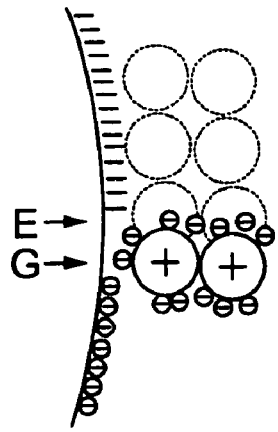
Figure 4A:
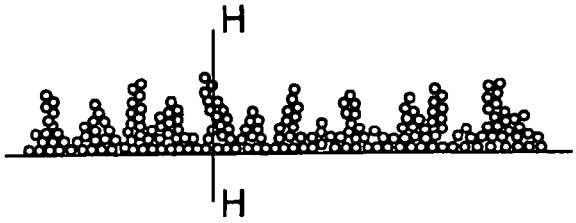
FIGS. 4A and 4B are views showing an example of a magnetic brush present in the longitudinal direction.
Figure 4B:
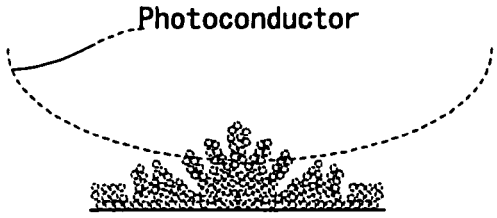
Figure 5A:
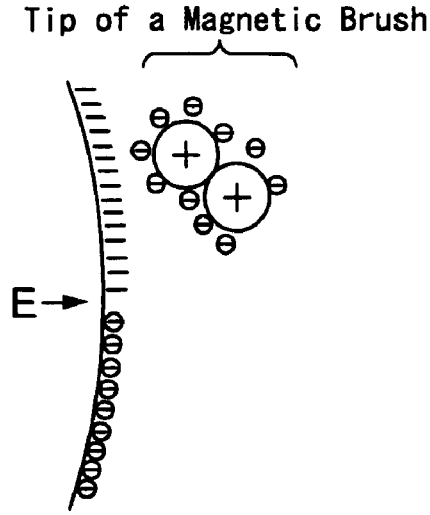
FIGS. 5A through 5C are views showing an example of the mechanism of the image omission at rear end when a development nip is narrowed.
Figure 5B:
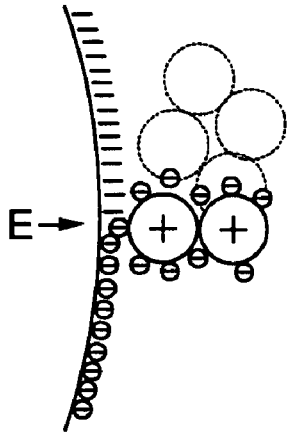
Figure 5C:
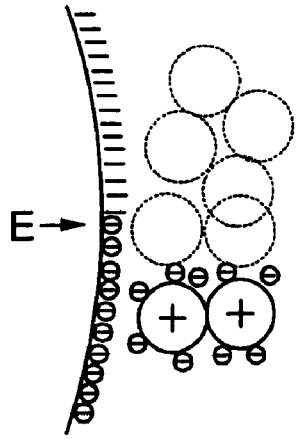
Figure 6A:
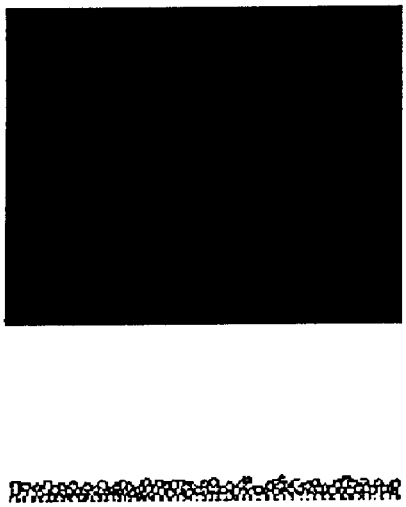
FIG. 6A shows an example of magnetic brushes according to the present invention.
Figure 6B:
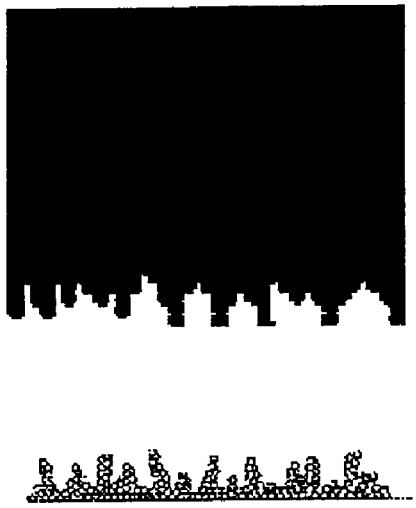
FIG. 6B shows an example of magnetic brushes at a development nip in the related art.
Figure 7:
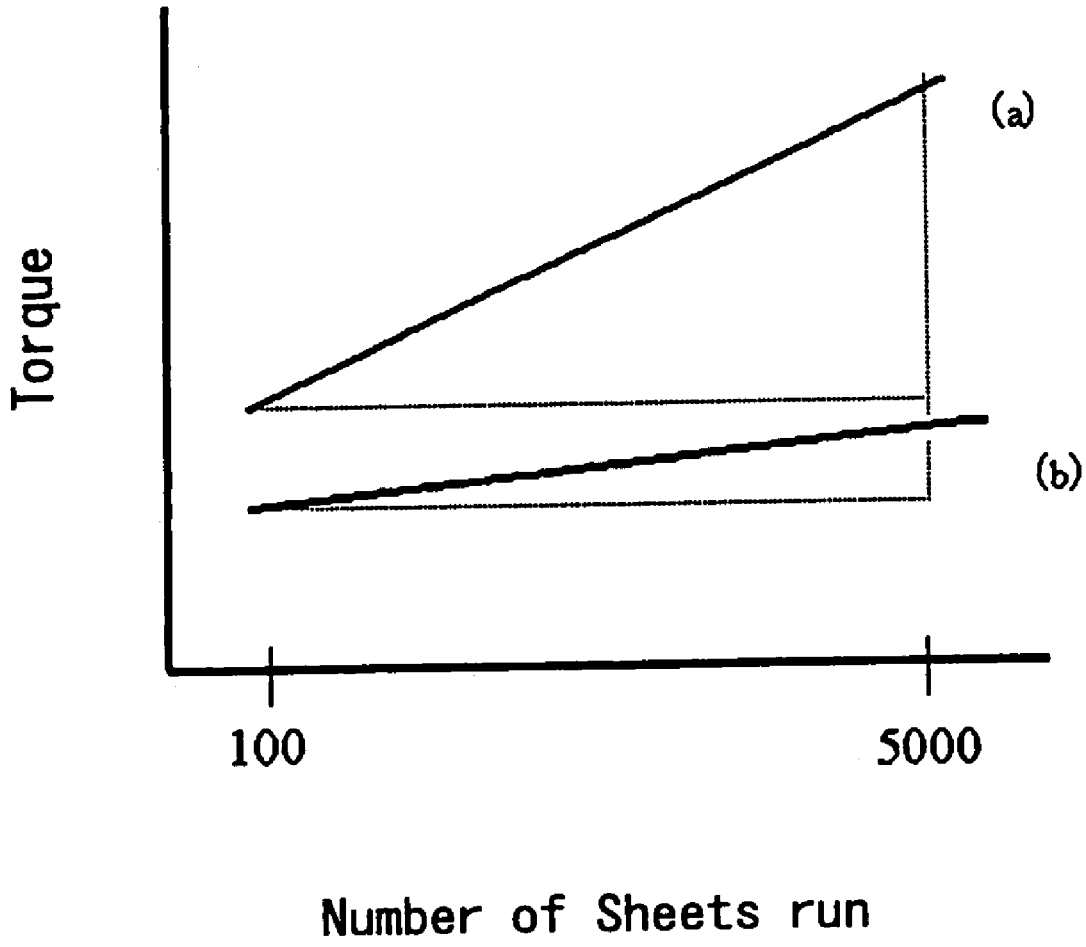
FIG. 7 is a graph showing a relationship between a magnetic roller difference and a torque.

As described above, in an image-forming process where magnetic brush density is increased to prevent abnormal images having, for example, image omission at rear end, image deterioration with time compared to the initial image was a serious problem. This image-forming process will be described in detail later. A comparative observation was first conducted regarding the torque difference affecting the magnetic brush with time, in a developing device (image-developer) using a process to increase magnetic brush density and comprising a magnetic roller (which can be referred to as the one the present invention applies to) which increases magnetic brush density, and in a developing device (image-developer) using a magnetic roller which does not increase magnetic brush density. FIG. 7 shows a result of the comparative observation for this torque difference. In the FIG. 7, the results of a case that utilizes a developing device (image-developer) comprising a magnetic roller which increases magnetic brush density are shown as (a), and the results of a case that utilizes a developing device (image-developer) comprising a magnetic roller which does not increase magnetic brush density are shown as (b). The measurement was carried out by connecting an ordinary torque measuring apparatus to the rotating gear part at one end of the magnetic roller. Specifically, the torque with time was measured, using a Data Logger NR2000 (available from KEYENCE CORPORATION). The results show that in the developing device (image-developer) comprising the magnetic roller (which the present invention applies to refer to (a) in the figure), the effect of the torque with time increases at a higher rate, compared to the initial state. In the other words, the stress given on the magnetic brush was larger, and due to this, the image quality with time deteriorates, compared to the initial state.

It has been discovered that the deterioration with time could be resolved, if the toner used in the developer have a specific particle distribution and formation, and specifically, if the ratio (Dv/Dn) and the circularity on average of the initial toner are within a specified range.

In general, it has been said that the smaller the particle diameter is, the higher the resolution and image quality can be obtained. However, this is disadvantageous for transfer properties and cleaning properties. Also, if the volume average particle diameter is smaller than the range defined by the present invention, in a double-component developer, toners become fused on the surface of a carrier, when stirred during long period of time in the developing device (image-developer), and charging properties of the carrier deteriorate. When used as a single-component developer, filming of the toner occurs on the development roller, and the toner tends to be fused on parts such as blades or the like, which make the layer of the toner thinner. In particular, if the amount of the toner having a superfine particle of 2.0 μm or less, specifically 0.6 μm to 2.0 μm, is more than 15% by number, there is a particular tendency for the toner to be fused on the surface of the carrier, for filming of the toner on the development roller, and for toner to be fused on parts such as blades which makes the layer of the toner thinner.

On the other hand, when the particle diameter is larger than the range defined by the present invention, it becomes difficult to obtain a high resolution and high-quality image, and when the toner in the developer is recycled, there is a big difference in the particle diameter.

Having a ratio (Dv/Dn) of 1.01 to 1.25, the toner has excellent hot storage properties, low temperature image-fixing properties and hot offset-resistance properties. In particular, glossiness is excellent when the toner is used in a full color copier, while in a double-component developer, it is found out that even when toner recycle is performed over long period of time, there is less variation of particle diameter distribution of the toner in the developer, and when stirred for long periods, in the developing device (image-developer), good, stable development properties can be obtained. If the ratio (Dv/Dn) is larger than 1.25, it is difficult to obtain a high resolution and high-quality image. When the toner in the developer is recycled, the particle diameter distribution of the toner tends to vary largely. On the other hand, if the ratio (Dv/Dn) is less than 1.01, although there are advantages from the viewpoint of stability of toner circulation and uniform charging amount, the toner charge is sometimes insufficient and cleaning is sometimes difficult. Accordingly, the ratio (Dv/Dn) is preferably 1.05 or more.

Figure 8:
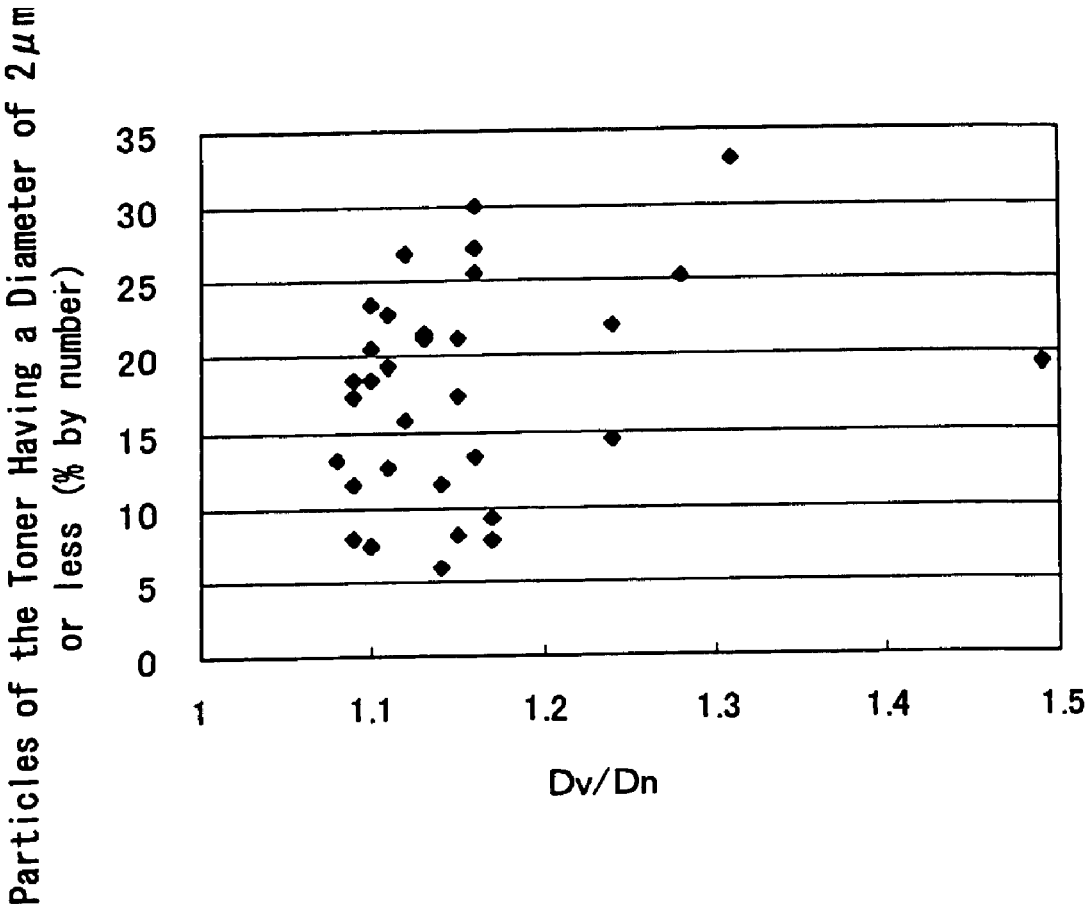
FIG. 8 is a graph showing a relationship between the ratio (Dv/Dn) and the amount of fine particles of toners having a particle diameter of 2 μm or less.

There is not always a correlation between the content of particles having a diameter of 0.6 μm to 2.0 μm and the ratio (Dv/Dn). However, in order to achieve the objects of the present invention, it is required that both of these properties are within the ranges defined by the present invention (refer to, the following Table 1). FIG. 8 shows the relationship between the ratio (Dv/Dn) and the amount of particles having a diameter of 2 μm or less than in the toner. As can be seen from the graph of FIG. 8, the ratio (Dv/Dn) and the amount of the particles are completely independent properties of the toner, from each other. The ratio (Dv/Dn) has been used to express the particle diameter distribution of the toner in the related art. However, to achieve the objects of the present invention, the amount of the particles is also an important property.

TABLE 1

Influence of the ratio (Dv/Dn) and the amount of toners having a particle diameter of 2 μm or less on image quality

| | | Content of the particles having a diameter of 2 μm or less | |
|---|---|---|---|
| | | 15% by number or less | more than 15% by number |
| Ratio (Dv/Dn) | 1.25 or less | Good | Filming on carrier or internal parts of apparatus |
| | 1.25 or more | Toner deposition on background of the image Poorer image quality | Filming on carrier or internal parts of apparatus occurs. Toner deposition on background of the image, and poorer image quality deteriorate |

From the viewpoints of development properties and transfer properties, the toners have a circularity of preferably 0.930 to 0.990 on average. If it is less than 0.930 on average, efficiency of toner transfer from the photoconductor to the transferring paper (recording medium) deteriorates. With the toner having such irregular formation of far deferent from the circularity, sufficient transfer properties and high image quality without toner scattering cannot be obtained. If it is more than 0.990 on average, it is difficult to clean the remaining toners which are not transferred on the photoconductor. With the toner having a circularity larger than 0.990 on average, in a system which utilizes blade cleaning, cleaning of the photoconductor and a transferring belt cannot be carried out appropriately, and this leads to contamination on the image. In developing and transferring where the image occupies a surface of the transfer paper (recording medium) in a small area, there is not much residual toner after transfer and cleaning is not a serious problem. When the image occupies a surface of the transfer paper (recording medium) in a large area such as in the case of an image of a color photograph, toners which are not transferred due to paper feed problems, or the like, may remain on the photoconductor after transfer. If the residual toners accumulate, the toner deposition on background of the image will occur. Further, the charging roller which contacts and gives charge to the photoconductor becomes contaminated. Therefore, a desirable charging performance cannot be obtained. The circularity is more preferably 0.930 to 0.990 on average, and is still more preferably 0.960 to 0.980 on average. A content of the toners having a circularity of less than 0.930 is preferably 15% or less.

In the image-forming process of the present invention, as described later, the aforesaid ranges for the ratio (Dv/Dn) and the circularity on average are particularly important for preventing image deterioration with time, and for forming an accurately and precisely reproduced image (high-quality image), having a suitable density when an image-forming process for increasing the magnetic brush density is used.

Formation coefficient (SF-1) can be measured as the circularity on average by, for example, a flow type particle image analyzer, APIA-2100 (available from Toa Medical Electronics).

It is particularly preferred that the formation coefficient (SF-1) of the toner is 105 to 140. If it is more than 140, the efficiency of transferring the toner from the photoconductor onto the transfer paper may deteriorate. If it is less than 105, it is difficult to clean toners which are not transferred and remain on the photoconductor. Herein, the formation coefficient (SF-1) expresses the degree of circularity of a toner, and is a value obtained by computation using the following equation:

$$SF\text{-}1-\{(\text{MIXING})^2/\text{AREA})\times(\pi/4)\times 100$$

where, "MIXING" expresses the absolute maximum length of the toner, and "AREA" expresses the projected surface area of the toner.

(External Additives)

It is important from the viewpoint of development properties and transfer properties that the ratio of the external additive to be blended in the toner is 0.3 parts by weight to 5.0 parts by weight relative to 100 parts by weight of the base of toner particle. If the ratio is less than 0.3 parts by weight, toner fluidability is insufficient, and efficiency of toner transfer from the photoconductor to the transfer paper (recording medium) deteriorates. On the other hand, if the ratio is more than 5.0 parts by weight, the external additive remains freely without adhering to the toner surface properly, adheres to and contaminates the surface of the photoconductor, or abrades the surface of the photoconductor: This may lead to side-effects such as image blurring, toner deposition on background of the image, or the like.

The external additive is preferably an inorganic particle, in order to improve fluidability and charging properties.

The primary particle diameter of the inorganic particle is preferably 5 μm to 2 μm, and more preferably 5 μm to 500 μm. The specific surface area measured by the BET method is preferably 20 $m^2/g$ to 500 $m^2/g$. Specific examples of the inorganic particle are silica, titanium oxide, alumina, barium titanate, magnesium titanate, calcium titanate, strontium titanate, zinc oxide, tin oxide, silica sand, clay, mica, silicic pyroclastic rock, silious earth, chromium oxide; cerium oxide, red iron oxide, antimony trioxide, magnesium oxide, zirconium oxide, barium sulfate, barium carbonate, calcium carbonate, silicon carbide, silicon nitride, and the like. These can be preferably used in combination.

In addition, the examples further include polymer particles, such as soap-free emulsion polymers or suspension polymers, polystyrene obtained by dispersion polymerization, methacrylic acid ester, acrylic acid ester copolymers, or the like; condensation polymers such as silicone, benzoguanamine, nylon, or the like; polymer particles obtained from thermosetting resins, and the like.

If these fluidizers (inorganic particles) are surface-treated to increase hydrophobicity, loss of fluidability and charging properties can be prevented even under high humidity. Examples of suitable surface treatment agents are silane coupling agents, silylating agents, silane coupling agents having a fluorinated alkyl group, organic titanate coupling agents, aluminium coupling agents, silicone oil, modified silicone oil, and the like.

The external additive utilized in the present invention is preferably silica, titanium oxide or alumina. Of the examples above, hydrophobic silica is particularly preferred.

[Modified Polyester Resin (i)]

The modified polyester resin (i) according to the present invention has a structure in which functional group in a monomer unit of acid and alcohol as well as a bonding group other than ester bonds in a polyester resin, or a structure in which resinous components having different structures are bonded in covalent bonding or in ionic bonding.

For example, the polyester terminal can be made to react by a moiety other than an ester bond. Specifically, a functional group such as isocyanate which reacts with acid groups and hydroxyl groups is introduced to the terminal, and reacted with an active hydrogen compound to modify the terminal, or made to undergo an extended reaction.

If the compound contains plural active hydrogen groups, the polyester terminals can be bonded together (e.g., urea-modified polyester, urethane-modified polyester, or the like).

A reactive group such as a double bond can be introduced into the polyester main chain, and a radical polymerization is initiated to introduce a carbon-carbon bonded graft component into the side chain or to crosslink the double bonds (styrene-modified polyester, acryl-modified polyester, or the like).

Alternatively, the resinous component having a different composition in the main chain of the polyester can be copolymerized or reacted with a terminal carboxyl group or hydroxyl group. For example, it can be copolymerized with a silicone resin in which the terminal is modified by carboxyl group, hydroxyl group, epoxy group, or mercapt group (silicone-modified polyester, or the like).

Specific examples will now be described.

[Examples of Synthesis of Polystyrene-Modified Polyester Resin (i)]

For example, 724 parts by weight of bisphenol A ethylene oxide bimolar adduct, 200 parts by weight of isophthalic acid, 70 parts by weight of fumaric acid, and 2 parts by weight of dibutyl tin oxide can be introduced into a reaction vessel equipped with a condenser, a stirrer and a nitrogen inlet tube. The reaction can be performed at 230° C. under atmospheric pressure for 8 hours. The reaction can be further performed under a reduced pressure of 10 mmHg to 15 mmHg for 5 hours, and then the reaction mixture can be cooled to 160° C. Thereafter, 32 parts by weight of phthalic anhydride can be added, and reacted for 2 hours. Subsequently, the reaction mixture was cooled to 80° C., and 200 parts by weight of styrene, 1 part by weight of benzoyl peroxide, and 0.5 parts by weight dimethylaniline can be added in ethyl acetate, the reaction can be then performed for 2 hours. Thereafter, ethyl acetate can be removed by distillation to give a polystyrene graft-modified polyester resin (i) having weight average molecular weight of 92000.

[Urea-Modified Polyester Resin (i)]

Examples of the urea-modified polyester resin (i) are the reaction product of a polyester prepolymer (A) which contains an isocyanate group, an amine (B), and the like. The polyester prepolymer which contains an isocyanate group (A) may be obtained by taking a polyester which is a condensation polymer of a polyol (1) and polycarboxylic acid (2), and which contains an active hydrogen group, and further reacting it with a polyisocyanate (3). Examples of the active hydrogen group in the above-mentioned polyester are a hydroxyl group (an alcoholic hydroxyl group and a phenolic hydroxyl group), an amino group, a carboxyl group, a sulfhydryl group, and the like. Of these, an alcoholic hydroxyl group is preferred.

Examples of the polyol (1) are a diol (1-1), a polyol (1-2) having a valency of 3 or higher, and the like. It is preferred that (1-1) is used alone, or that a mixture of (1-1) with a small amount of (1-2) is used.

Examples of the diol (1-1) are alkylene glycols (ethylene glycol, 1,2-propylene glycol, 1,3-propylene glycol, 1,4-butanediol, 1,6-hexane diol, or the like); alkylene ether glycols (diethylene glycol, triethylene glycol, dipropylene glycol, polyethylene glycol, polypropylene glycol, polytetramethylene ether glycol, or the like); alicyclic diols (1,4-cyclohexanedimethanol, hydrogenated bisphenol A, or the like); bisphenols (bisphenol A, bisphenol F, bisphenol S, or the like); alkylene oxide (ethylene oxide, propylene oxide, butylene oxide, or the like); adducts of the aforesaid alicyclic diols; alkylene oxide (ethylene oxide, propylene oxide, butylene oxide, or the like) adducts of the aforesaid bisphenols, and the like. Of these, alkylene oxide adducts of alkylene glycols and bisphenols having 2 to 12 carbon atoms are preferred, alkylene oxide adducts of bisphenols or concurrent use with alkylene glycols having 2 to 12 carbon atoms are particularly preferred.

Examples of the polyol (1-2) having a valency of 3 or more are polyvalent aliphatic alcohols having a valency of 3 to 8 or more (glycerol, trimethylolethane, trimethylolpropane, pentaerythritol, sorbitol, or the like); phenols having a valency of 3 or more (trisphenol PA, phenol novolak, cresol novolak, or the like); alkylene oxide adducts of these polyphenols having a valency of 3 or more; and the like.

The polycarboxylic acid (2) may be a dicarboxylic acid (2-1) or a polycarboxylic acid (2-2) having a valency of 3 or more. It is preferred that (2-1) is used alone, or that a mixture of (2-1) with a small amount of (2-2) is used.

Examples of the dicarboxylic acid (2-1) are alkylene dicarboxylic acids (succinic acid, adipic acid, sebacic acid, or the like); alkenylene dicarboxylic acids (maleic acid, fumaric acid, or the like); and aromatic dicarboxylic acids (phthalic acid, isophthalic acid, terephthalic acid, naphthalene dicarboxylic acid, or the like). Of these, alkenylene carboxylic acids having 4 to 20 carbon atoms and aromatic dicarboxylic acids having 8 to 20 carbon atoms are preferred.

Examples of the polycarboxylic acid (2-2) having a valency of 3 or more are an aromatic polycarboxylic acid having 9 to 20 carbon atoms (trimellitic acid, pyromellitic acid, or the like); and the like.

The polycarboxylic acid (2) may be reacted with the polyol (1) using the aforesaid acid anhydride or a lower alkyl ester (methyl ester, ethyl ester, isopropyl ester).

The ratio of the polyol (1) to polycarboxylic acid (2) is usually 2/1 to 1/1, is preferably 1.5/1 to 1/1 and is more preferably 1.3/1 to 1.02/1, in terms of the equivalence ratio [OH]/[COON] of hydroxyl groups [OH] to carboxyl groups [COOH].

Examples of the polyisocyanate (3) are aliphatic polyisocyanates (tetramethylene diisocyanate, hexamethylene diisocyanate, 2,6-diisocyanate methyl capronate, or the like); alicyclic polyisocyanate (isohorone diisocyanate, cyclohexyl methane diisocyanate, or the like); aromatic diisocyanates (tolylene diisocyanate, diphenylmethane diisocyanate, or the like); aromatic aliphatic diisocyanate (a, a, a', a'-tetramethylxylylene diisocyanate, or the like); isocyanurates; polyisocyanates blocked with phenol derivatives, oximes, caprolactams, or the like; and two or more thereof used in combination.

The ratio of polyisocyanates (3) is usually 5/1 to 1/1, is preferably 4/1 to 1.2/1, and is more preferably 2.5/1 to 1.5/1, in terms of the equivalence ratio [NCO]/[OH] of isocyanate groups [NCO] and hydroxyl groups [OH] of hydroxyl group-containing polyesters. If the ratio of [NCO]/[OH] is more than 5, low temperature image-fixing properties deteriorate. If the molar ratio of [NCO] is less than 1, the urea content of the modified polyester decreases and hot offset-resistance properties deteriorate.

The amount of the polyisocyanate (3) component in the prepolymer (A) having a terminal isocyanate group is 0.5% by weight to 40% by weight, is preferably 1% by weight to 30% by weight and is more preferably 2% by weight to 20% by weight. If it is less than 0.5% by weight, hot offset-resistance properties deteriorate. It is therefore disadvantageous in respect of obtaining both heat-resistant storage properties and low temperature image-fixing properties at the same time. If it is more than 40% by weight, low temperature image-fixing properties deteriorate.

The number of isocyanate groups per molecule of the prepolymer (A) having an isocyanate group, is usually 1 or more, is preferably 1.5 to 3 on average, and is more preferably 1.8 to 2.5 on average. If it is less than 1 per molecule, the molecular weight of the modified polyester resin (i) is low, and hot offset-resistance properties deteriorate.

The amine (B) may be a diamine (B1), a polyamine (B2) having a valency of 3 or more, an aminoalcohol (B3), aminomercaptan (B4), amino acid (B5), a compound (B6) in which the amino group of (B1) through (B5) is blocked, and the like. Examples of the diamine (B1) are aromatic diamines (phenylenediamine, diethyltoluenediamine, 4,4'-diaminodiphenylmethane, or the like); alicyclic diamines (4,4'-diamino-3,3'-dimethyldicyclohexylmethane, diamine cyclohexane, isoholon diamine, or the like); aliphatic diamines (ethylenediamine, tetramethylenediamine, hexamethylenediamine, or the like).

Examples of the polyamine (B2) having a valency of 3 or more are diethylene triamine, triethylene tetramine, and the like. Examples of the aminoalcohol (B3) are ethanolamine, hydroxyethylaniline, and the like:

Examples of the aminomercaptan (B4) are aminoethyl mercaptan, aminopropyl mercaptan, and the like.

Examples of the amino acid (B5) are aminopropionic acid, aminocaproic acid, and the like.

Examples of compounds in which the amino group of (B1) through (B5) is blocked, are ketimine compounds obtained from the amines (B1) through (B5) and ketones (acetone, methyl ethyl ketone, methyl isobutyl ketone, or the like), oxazoline compounds, and the like. Of these amines (B), (B1) and mixtures of (B1) with a small amount of (B2) are preferred.

The molecular weight of modified polyester resin (i) can be adjusted, using an extension stopping agent, if necessary. Examples of the extension-stopping agent are monoamines (diethylamine, dibutylamine, butylamine, laurylamine, or the like), compounds in which these are blocked (ketimine compounds), and the like.

The ratio of amines (B) is usually 1/2 to 2/1, is preferably 1/5/1 to 1/1.5, and is more preferably 1.2/1 to 1/1.2, in terms of the equivalence ratio [NCO]/[NHx] of isocyanate groups [NCO] in the isocyanate group-containing prepolymer (A) and amino groups [NHx] in the amine (B). If the ratio of [NCO]/[NHx] is more than 2, or is less than ½, the molecular weight of the urea-modified polyester resin (i) is low, and hot offset-resistance properties deteriorate. In the present invention, the modified polyester resin (i) may contain urethane bonds together with urea bonds. The molar ratio of a content of the urea bonds to a content of the urethane bonds is usually 100/0 to 10/90, is preferably 80/20 to 20/80, and is more preferably 60/40 to 30/70.

If the molar ratio of the urea bonds is less than 10%, hot offset-resistance properties deteriorate.

The modified polyester resin (i) of the present invention may be manufactured by the one-shot method or the prepolymer method.

The weight average molecular weight of the modified polyester resin (i) is usually 10000 or more, is preferably 20000 to 10 million and is more preferably 30000 to 1 million. If it is less than 10000, hot offset-resistance properties deteriorate. The number average molecular weight of the modified polyester resin (i) is not particularly limited when used together with the non-modified polyester resin (ii), as described later, and may be the number average molecular weight at which the aforesaid weight average molecular weight can be easily obtained. When the modified polyester resin (i) is used alone, the number average molecular weight is usually 20000 or less, is preferably 1000 to 10000, and is more preferably 2000 to 8000.

If the number average molecular weight is more than 20000, low temperature image-fixing properties and glossiness when used in full color image-forming apparatuses deteriorate.

[Non-Modified Polyester Resin (ii)]

In the present invention, the aforesaid modified polyester resin (i) may not only be used alone, but the non-modified polyester resin (ii) may also be contained together with the modified polyester resin (i) as a resin for the toner for developing a latent electrostatic image. By using the non-modified polyester resin (ii) together, low temperature image-fixing properties and glossiness when used in full color image-forming apparatuses improve, and this is therefore preferred to using the modified polyester resin (i) alone. The non-modified polyester resin (ii) may be a polycondention product of the polyol (1) and the polycarboxylic acid (2). Preferable examples of the non-modified polyester (ii) are similar to that of the above polyester component (i).

It is also preferred that at least a portion of the modified polyester resin (i) and the non-modified polyester resin (ii) are mutually compatible, from the viewpoint of low temperature image-fixing properties and hot offset-resistance properties. Therefore, it is preferred that the polyester component of the modified polyester resin (i) and the polyester component of the non-modified polyester resin (ii) have similar compositions.

The weight ratio of the modified polyester resin (i) and the non-modified polyester resin (ii) is usually 5/95 to 80/20, is preferably 5/95 to 30/70, is more preferably 5/95 to 25/75 and is still more preferably 7/93 to 20/80. If the weight ratio of the modified polyester resin (i) is less than 5%, hot offset-resistance properties deteriorate, and it is disadvantageous from a viewpoint of obtaining both heat-resistant storage properties and -low temperature image-fixing properties.

The peak molecular weight of the non-modified polyester resin (ii) is usually 1000 to 20000, is preferably 1500 to 10000 and is more preferably 2000 to 8000. If it is less than 1000, heat-resistant storage properties deteriorate. If it is more than 10000, low temperature image-fixing properties deteriorate.

The hydroxyl value of the non-modified polyester resin (ii) is preferably 5 or more, is more preferably 10 to 120 and is still more preferably 20 to 80. If it is less than 5, it is disadvantageous from the viewpoint of obtaining both heat-resistant storage properties and low temperature image-fixing properties at the same time. The acid value of the non-modified polyester resin (ii) is preferably 10 to 30. By giving the acid value, a negative electrostatic charge can be easily acquired and fixability is excellent. If the acid value is more than 30, in particular under high temperature and high humidity conditions, the charge amount of the toner may decrease and the contamination on the image may occur.

In the present invention, the glass transition temperature (Tg) of the non-modified polyester resin (ii) is usually 35° C. to 55° C., and preferably 40° C. to 55° C. If the glass transition temperature (Tg) is less than 35° C., heat-resistant storage properties of the toner deteriorate. If it is more than 55° C., low temperature image-fixing properties of the toner is insufficient. In a dry toner such as the toner for developing a latent electrostatic image of the present invention, due to the presence of the modified polyester resin (i), heat-resistant storage properties tend to be good, compared to the polyester toners known in the art, even if the glass transition temperature is low.

In the present invention, the temperature (TG') at which the storage modulus of the binder resin of the toner is 10000 dyne/cm$^2$ at a frequency of 20 Hz, is usually 100° C. or higher, and is preferably 110° C.-to 200° C. If it is less than 100° C., hot offset-resistance properties deteriorate. The temperature (Tη) at which the viscosity of the binder resin of the toner is 1000 poise at a frequency of 20 Hz, is usually 180° C. or less, and is preferably 90° C. to 160° C. If it is more than 180° C., low temperature image-fixing properties deteriorate. Specifically, from the viewpoint of obtaining both low temperature image-fixing properties and hot offset-resistance properties at the same time, TG' is preferably higher than Tη.

In other words, the difference (TG'−Tη) of TG' and Tη is preferably 0° C. or more. It is more preferably 10° C. or more, and is still more preferably 20° C. or more. There is no particular restriction as to the upper limit. From the viewpoint of obtaining both heat-resistant storage properties and low temperature image-fixing properties at the same time, the difference of Tη and Tg is preferably 0° C. to 100° C., is more preferably 10° C. to 90° C. and still more preferably 20° C. to 80° C.

(Coloring Agent)

The coloring agent in the toner of the present invention may be any dye or pigment known in the art. Examples of the coloring agent are carbon black, nigrosine dye, iron black, naphthol yellow S, Hanza yellow (10G, 5G, G), cadmium yellow, yellow iron oxide, ocher, chrome yellow, titanium yellow, polyazo yellow, oil yellow, Hanza yellow (GR, A, RN, R), pigment yellow L, benzidine yellow (G, GR), permanent yellow (NCG), Balkan fast yellow (5G, R), tartrazine lake, quinoline yellow lake, anthracene yellow BGL, isoindolinone yellow, red iron oxide, minimum, lead vermilion, cadmium red, cadmium mercury red, antimony vermilion, Permanent-Red 4R, Para Red, Fire Red, p-chloro-o-nitroaniline red, risol fast scarlet, brilliant fast scarlet, Brilliant Carmine BS, permanent red (F2R, F4R, FRL, FRLL, F4RH), fast scarlet VD, Vulcan Fast Rubine B, brilliant scarlet G, Lithol Rubine GX, permanent-Red F5R, brilliant carmine 6B, Pigment Scarlet 3B, Bordeaux 5B, Toluidine Maroon, Permanent Bordeaux F2K, Helio Bordeaux BL, bold 10B, BON Maroon Light, BON Maroon Medium, eosine lake, rhodamine lake B, rhodamine lake Y, alizarin lake, Thioindigo Red B, Thioindigo Maroon, oil red, quinacridone red, pyrazolone red, polyazo red, chrome vermilion, benzidine orange, Perynone Orange, oil orange, cobalt blue, cerulean blue, alkali blue lake, peacock blue lake, Victoria blue lake, non-metallic phthalocyanine blue, phthalocyanine-blue, fast sky blue, Indanthrene Blue (RS, BC), indigo, ultramarine blue, Berlin blue, anthraquinone blue, fast violet B, methyl violet lake, cobalt purple, manganese purple, dioxane violet, anthraquinone violet, chrome green, zinc green, chrom oxide, viridian, emerald green, pigment green B, naphthol green B, green gold, acid green lake, malachite-green lake, phthalocyanine green, anthraquinone green, titanium oxide, zinc white, lithopone, and mixtures thereof, and the like. The content of the coloring agent is usually 1% by weight to 15% by weight, and is preferably 3% by weight to 10% by weight, relative to the toner.

The coloring agent used in the present invention can also be used as a masterbatch which is complexed with a resin.

To manufacture the masterbatch, or as a binder resin which is kneaded with the masterbatch, in addition to the modified or non-modified polystyrene resins mentioned above, polymers of styrene and derivatives thereof such as polystyrene, poly p-chlorostyrene, polyvinyl toluene or the like; styrene copolymers such as styrene-p-chlorostyrene copolymer, styrene-propylene copolymer, styrene-vinyltoluene copolymer, styrene-vinyl naphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-a-chloromethyl methacrylate copolymer, styrene-acrylonitrile copolymer, styrene-vinylmethylketone copolymer, styrene-butadiene copolymer, styrene-isoprene copolymer, styrene-acrylonitrile-indene copolymer, styrene copolymers such as styrene-maleic acid copolymer, styrene-maleate copolymers, or the like; polymethylmethacrylate, polybutylmethacrylate, polyvinyl chloride, polyvinyl acetate, polyethylene, polypropylene, polyester, epoxy resins, epoxy polyol resins, polyurethanes, polyamides, polyvinyl butyral, polyacrylic resins, rosin, modified rosin, terpene resin, aliphatic or alicyclic hydrocarbon resins, aromatic petroleum resins, chlorinated paraffin and paraffin wax. These may be used either alone or in combination of two or more.

The masterbatch can be obtained by mixing a resin for the masterbatch and coloring agent with a high shear force and kneading. In order to enhance the interaction between the coloring agent and the resin, an organic solvent may be used. Also, the flushing method may be used in which an aqueous paste of the coloring agent that contains water is mixed and kneaded together with a resin and an organic solvent, so that the coloring agent approaches to the resin, and the water and organic solvent components are removed thereafter. This method is preferred because a wet cake of the coloring agent can be used directly. Thus there is no need for drying. For the mixing and kneading, a high shear dispersing machine such as a three roller mill, or the like can be used.

(Release Agent)

The toner of the present invention may also contain wax together with the binder resin and the coloring agent of the toner. As a result of studies performed by the inventors of the present invention, it has been discovered that the state of the wax-in-the toner has a major effect on the mold release properties of the toner during image-fixing, and it has been also found out that if the wax is dispersed in the toner so that a large amount of the wax become present in the toner near the surface, good image-fixing mold release properties can be obtained. In particular, the wax is dispersed to 1 μm or less in terms of the longer diameter. However, if the release agent is present on the surface of the toner in a large amount, due to stirring for long periods in the developing device (image-developer), the wax may tend to separate from the surface of the toner and attracted to a surface of the carrier, stick to the surfaces of the members in the developing device (image-developer), and reduce the charge amount of the developer, which is undesirable. The dispersion of the release agent can be determined from an enlarged photograph which is obtained using a transmission electron microscope.

The wax may be any of those known in the art. Examples of the wax are polyolefin wax (polyethylene wax, polypropylene wax, or the like); a long chain hydrocarbon (paraffin wax, Sasol wax, or the like); a carbonyl group-containing wax, and the like. Of these, the carbonyl group-containing wax is preferred. Examples of the carbonyl group-containing wax is polyalkane acid esters (carnauba wax, montan wax, trimethyloylpropane tribehenate, pentaerythrytol tetrabehenate, pentaerythrytol diacetate dibehenate, glyceryl tribehenate, 1,18-octadecanediol distearate, or the like); polyalkenol esters (trimellitic acid tristearyl, distearyl maleate, or the like); polyalkane acid amides (ethylenediamine dibehenylamide, or the like); polyalkylamides (trimellitic tristearylamides, or the like); dialkyl ketones (distearylketone, or the like), and the like. Of the carbonyl group-containing wax, the polyalkane acid esters are preferred.

The melting point of the wax used in the present invention is usually 40° C. to 160° C., is preferably 50° C. to 120° C. and is more preferably 60° C. to 90° C. If the melting point of the wax is less than 40° C., there is an adverse effect on heat resistance storage properties. If the melting point of the wax is more than 160° C., cold offset during image-fixing tends to occur at low temperature. Further, the melting viscosity of the wax is preferably 5 cps to 1000 cps, is more preferably 10 cps to 100 cps, which is the value measured at a temperature 20° C. higher than the melting point. If the melting viscosity of the wax is more than 1000 cps, there is not much improvement of hot offset-resistance properties and low temperature image-fixing properties.

The content of the wax in the toner is usually 0% by weight to 40% by weight, and is preferably 3% by weight to 30% by weight. (Charge control substance)

The toner of the present invention may further contain a charge control substance if required. If a charge control substance is attracted to the toner surface, it is possible to give a high charge amount to the toner. Specifically, by embedding the charge control substance to the surface of the toner, its amount and state on the toner surface are stabilized, and the charging amount can be stabilized. In the toner having the composition of the present invention, charging amount stability is enhanced.

Any of the charge control substances known in the art may be used. Examples of the charge control substance are negrosine dyes, triphenylmethane dyes, chrome-containing complex dyes, molybdic acid chelate dyes, rhodamine dyes, alkoxy amines, quaternary ammonium salts (including fluorinated quaternary ammonium salts), alkyl amides, phosphorus or its compounds, tungsten or its compounds, fluorine activating agents, salicylic acid metal complexes, metal salts of salicylic acid derivatives, and the like.

Specific examples are Bontron 03 as the negrosine dye, Bontron P-51 as the quaternary ammonium salt, Bontron S-34 as the alloy metal azo dye, oxynaphthoic acid metal complex E-82, the salicylic acid metal complex E-84, the phenolic condensate E-89 (available from Orient Chemical Industries), the quaternary ammonium salt molybdenum complexes TP-302, TP-415 (available from Hodogaya Chemical Industries), the quaternary ammonium salt Copy Charge PSY VP2038, the triphenylmethane derivative Copy Blue PR, the quaternary ammonium salt Copy Charge NEG VP2036, the Copy Charge NX VP434 (available from Hoechst), LRA-901, LR-147 as the boron complex (available from Japan Carlit Co., Ltd.), copper phthalocyanine, perylene, quinacridone, azo pigments and other polymer compounds containing a functional groups such as sulfonic acid group, carboxylic acid group, quaternary ammonium salt, or the like.

The amount of the charge control substance in the present invention is determined according to the type of the binder resin, the presence or absence of additives which may be used if necessary, and the process for manufacturing the toner including the dispersion method. Although this is not a universal limitation, the amount of the charge control substance maybe 0.1 part by weight to 10 parts by weight relative to 100 parts by weight of the binder resin. It is preferred that the amount of the charge control substance is 0.2 parts by weight to 5 parts by weight. If it is more than 10 parts by weight, the charge amount for the toner is excessively large, the effect of the main charge control substance is diminished, the electrostatic attraction with the development roller increases, and this therefore leads to a deterioration in fluidity of the developer and decrease of image density.

These charge control substances and release agents may be melt kneaded together with the resin, and may of course be added upon dissolution or dispersion in an organic solvent.

A cleaning improving agent can also be added in order to remove the developer remaining on the photoconductor after transferor the primary transfer to the recording medium (transfer paper). The cleaning improving agent may be a fatty acid metal salt such as zinc stearate, calcium stearate, stearic acid, or the like; or polymer particles manufactured by soap-free emulsion polymerization such as polymethylmethacrylate particles, polystyrene particles, or the like. The polymer particles preferably have a relatively narrow particle size distribution, and a volume average particle diameter of 0.01 μm to 1 μm.

(Process for Manufacturing)

A typical process for manufacturing the toner of the present invention will now be described.

The binder resin of the toner may be manufactured by the following process.

The polyol (1) and polycarboxylic acid (2) are heated to 150° C. to 280° C. in the presence of an esterification catalyst known in the art such as a tetrabutoxy titanate, dibutyl tin oxide, or the like. Next, the water produced in the reaction is distilled off under reduced pressure if necessary, and a polyester which contains hydroxyl groups is thereby obtained. Thereafter, the polyisocyanate (3) is reacted with the polyester which contains hydroxyl groups at 40° C. to 140° C. so as to obtain the prepolymer (A) which contains isocyanate groups. The amine (B) is then reacted with this prepolymer (A) at 0° C. to 140° C. in order to obtain the modified polyester resin (i). When the polyisocyanate (3) is reacted, and the prepolymer (A) which contains isocyanate groups is reacted with the amine (B), a solvent may also be used, if necessary. Examples of solvents which can be used are compounds that are inert with respect to the isocyanate (3). The examples include aromatic solvents (toluene, xylene, or the like); ketones (acetone, methyl ethyl ketone, methyl isobutyl ketone, or the like); esters (ethyl acetate, or the like); amides (dimethyl formamide, dimethyl acetamide, or the like), ethers (tetrahydrofuran, or the like.), and the like.

When the non-modified polyester resin (ii) which is not modified by urea bonds is used in manufacturing the toner as well, the non-modified polyester resin (ii) is manufactured by an identical process to that used for a polyester which contains hydroxyl groups, and is then dissolved in the solvent after completion of the reaction for manufacturing the aforesaid modified polyester resin (i).

Specifically, the toner of the present invention can be manufactured by the following process. The process is not limited to the below, however.

(Melt Kneading and Crushing)

The toner composition including the binder resin which contains the modified polyester resin (i), the charge control substance and pigment are mixed with a machine. In this mixing step, the mixing is not particularly limited, and can be conducted under the usual conditions using an ordinary mixer having rotating blades.

After the mixing step is complete, the mixture is then introduced into a kneader and is then melt kneaded. The melt kneader may be a one shaft or two shaft continuous kneader, or a batch kneader using a roll mill.

It is important that this melt kneading be performed under suitable conditions which do not cause cleavage of the molecular chains of the binder resin. Specifically, the melt kneading temperature should be selected in view of the softening point of the binder resin of the toner. If it is performed at a temperature too far below the softening point, molecular cleavage is severe. If it is too high, dispersion does not take place.

When the aforesaid melt kneading step is complete, the kneaded product is pulverized. In this pulverizing step, the product is preferably first coarsely crushed, and then finely pulverized. Pulverizing methods which may conveniently be used are impact on an impact plate in a jet air current, and mechanical crushing in a narrow gap between a rotating rotor and a stator.

After this pulverizing step is complete, the pulverized product is classified in an air current by centrifugal force or the like. A toner having the predetermined particle diameter, e.g., an average particle diameter of 5 μm to 20 μm, is thereby manufactured.

Also in the preparation of the toner, in order to enhance toner fluidity, storage properties, development properties and transfer properties, inorganic particles such as the aforesaid hydrophobic silica particles may be added to the toner thus manufactured. The mixing of the external additives may be performed in an ordinary powder mixer. It is preferred to further provide a jacket or the like, so that the temperature inside the ordinary powder mixer can be adjusted. To modify the negative charge imparted to the external additives, the external additives may be added midway or be added gradually during the process. Speed of rotation, speed of rolling motion, time, temperature, or the like may of course also be varied A strong negative charge may first be given followed by a relatively weak negative charge. The relatively weak negative charge may first be given followed by the strong negative charge.

Examples of mixing devices which can be used are a V-shaped mixer, rocking mixer, redige mixer, nauta mixer, Henschel mixer, and the like.

To render the toner thus obtained spherical, the toner materials comprising the binder resin and coloring agent which have been melt kneaded and pulverized, may be made spherical by mechanical means using a hybrid mixer or Mechanofusion, or by the spray dry method in which the toner materials are dissolved and dispersed in a solvent in which the binder resin of the toner is soluble, the solvent then being removed using a spray dry apparatus. Alternatively, the toner may be rendered spherical by heating in an aqueous medium, but these methods are not limited thereto.

(Process for Manufacturing the Toner in Aqueous Medium)

The aqueous medium used in the present invention may be water used alone, or water used together with a miscible solvent. Examples of such miscible solvents are alcohols (methanol, isopropanol, ethylene glycol, or the like), dimethylformamide, tetrahydrofuran, cellusolves (methyl cellusolve, or the like.), lower ketones (acetone, methyl ethyl ketone, or the like).

The particles of the toner may be formed by reacting a dispersant comprising a prepolymer (A), having isocyanate groups with amines (B) in the aqueous medium, or the modified polyester resin (i) manufactured previously, may be used. One of the processes for stably forming the dispersant comprising the modified polyester resin (i) or prepolymer (A) in an aqueous medium, is to add a toner initial material composition comprising the modified polyester resin (i) or prepolymer (A) to the aqueous medium, and disperse it by shear force. The prepolymer (A) and other toner components (hereafter, referred to as toner initial materials) such as a coloring agent, coloring agent masterbatch, release agent, charge control substance, the non-modified polyester resin (ii), and the like may be added when the dispersant is formed in the aqueous medium. It is preferred to first mix the toner initial materials together, and then disperse this mixture in the aqueous medium. Further, according to the present invention, it is not absolutely necessary to add other toner initial materials such as a coloring agent, release agent, charge control substance, and the like, when the particles are formed in the aqueous medium, and they may be added after the particles have been formed. For example, after forming particles which do not contain a coloring agent, a coloring agent can be added by a dyeing method known in the art.

There is no particular limitation on the dispersion method which may employ any dispersion apparatus known in the art such as low speed shear, high speed shear, friction, high-pressure jet, ultrasound, or the like. To obtain a dispersant particle having a diameter of 2 μm to 20 μm, the high speed shear is preferred. When a high speed shear dispersion apparatus is used, there is no particular limitation on the rotation speed, which is usually 1000 rpm to 30000 rpm, and is preferably 5000 rpm to 20000 rpm. There is no particular limitation on the dispersion time, but in the case of a batch process, this is usually 0.1 minute to 5 minutes. The temperature in the dispersion is usually 0° C. to 150° C. (under pressure), and is preferably 40° C. to 98° C. If a higher temperature is used, the viscosity of the dispersant comprising the modified polyester resin (i) or prepolymer (A) is lower, and dispersing is easier, which is desirable.

The amount of the aqueous medium relative to 100 parts by weight of the toner composition comprising the polyester resin (i) or prepolymer (A) is usually 50 parts by weight to 2000 parts by weight, and is preferably 100 parts by weight to 1000 parts by weight. If it is less than 50 parts by weight, the dispersion state of the toner composition is poor, and particles having the predetermined particle diameter are not obtained. If it is more than 20000 parts by weight, it is not economical. A dispersion agent can also be added if necessary. The use of a dispersion agent makes the particle distribution sharp and stabilizes the dispersion, and is therefore desirable.

Examples of dispersion agents which can be used to emulsify and disperse the oil phase in which the toner composition is dispersed, in a liquid containing water, are anionic surfactants such as alkyl benzene sulfonates, α-olefin sulfonates, phosphoric acid esters, or the like; amine salts such as alkylamine salts, aminoalcohol fatty acid derivatives, polyamine fatty acid derivatives, imidazoline, or the like; quaternary ammonium salt cationic surfactants such as alkyltrimethyl ammonium salts, dialkydrimethyl ammonium salts, alkyl dimethyl benzyl ammonium salts, pyridinium salts, alkyl isoquinolinium salts, benzetonium chloride, or the like; nonionic surfactants such as fatty acid amide derivatives, polyvalent alcohol derivatives, or the like; amphoteric surfactants such as aniline, dodecyldi(aminoethyl)glycine, di(octylaminoethyl)glycine, N-alkyl-N,N-dimethylammoniumbetaine, or the like; and the like.

By using a surfactant having a fluoroalkyl group, an effect can be obtained with an extremely small amount of the surfactant. Examples of anionic surfactants having a fluoroalkyl group which, can be conveniently be used are fluoroalkyl carboxylic acids having 2-10 carbon atoms and metal salts thereof, disodium perfluorooctane sulfonylglutamate, sodium 3-[omega-fluoroalkyl (C6 to C11) oxy]-1-alkyl (C3 to C4) sulfonate, sodium 3-[omega-fluoroalkanoyl (C6 to C8)-N-ethylamino]-1-propane sulfonate, fluoroalkyl (C11 to C20) carboxylic acids and metal salts thereof, perfluoroalkyl carboxylic acids (C7 to C13) and metal salts thereof, perfluoroalkyl (C4 to C12) sulfonates and metal salts thereof, perfluorooctanesulfonic acid diethanolamide, N-propyl-N-(2-hydroxyethyl) perfluorooctane sulfonamide, perfluoroalkyl (C6 to C10) sulfonamide propyltrimethylammonium salt, perfluoroalkyl (C6 to C10)—N-ethylsulfonyl glycine salt, monoperfluoroalkyl (C6 to C16) ethyl phosphoric acid ester, acrid the like.

Examples of the commercial products are Surflon S-111, Surflon S-112, Surflon S-113 (available from Asahi Glass Co., Ltd.), Fluoride FC-93, Fluoride FC-95, Fluoride FC-98, Fluoride FC-129 (available from Sumitomo 3M, Co., Ltd.), Unidyne DS-101, DS-102 (available from Daikin Industries, Ltd.), Megafac F-110, Megafac F-120, Megafac F-113, Megafac F-191, Megafac F-812, Megafac F-833 (available from Dainippon Ink and Chemicals Incorporated), Ektop EF-102, EF-103, EF-104, EF-105, EF-112, EF-123A, EF-123B, EF-306A, EF-501, EF-201, EF-204 (available from Tohkem Products Corporation), FTERGENT F-100, FTERGENT F-150 (available from NEOS), and the like.

Examples of cationic surfactants are primary, secondary or tertiary amines having a fluoroalkyl group, quaternary ammonium salts of fatty acids such as perfluoroalkyl (C6 to C10) sulfonamide propyltrimethylammonium salt, or the like; benzalkonium salts, benzetonium chloride, pyridinium chloride and imidazolinium salts, examples of commercial products being Surflon S-121 (available from Asahi Glass Co., Ltd.), Fluoride FC-135 (available from Sumitomo 3M). Unidyne DS-202 (available from Daikin Industries, Ltd.), Megafac F-150, Megafac F-824 (available from Dainippon Ink and Chemicals Incorporated), Ektop EF-132 (available from Tohkem Products Corporation), FTERGENT F-300 (available from NEOS), and the like.

Inorganic compound dispersing agents difficulty soluble in water such as tricalcium phosphate, calcium carbonate, titanium oxide, colloidal silica, hydroxyapatite, or the like can also be used.

The dispersion drops may also be stabilized by a polymer protecting colloid. Examples are acids such as acrylic acid, methacrylic acid, α-cyanoacrylic acid, α-cyanomethacrylic acid, itaconic acid, crotonic acid, fumaric acid, maleic acid, malefic anhydride, or the like; (meth)acrylic monomers which contain hydroxyl groups such as β-hydroxyethyl acrylic acid, β-hydroxyethyl methacrylic acid, β-hydroxypropyl acrylic acid, β-hydroxypropyl methacrylic acid, γ-hydroxypropyl acrylic acid, γ-hydroxypropyl methacrylic acid, 3-chloro-2-hydroxypropyl methacrylic acid, diethylene glycol monoacrylic acid ester, diethylene glycol monomethacrylic acid ester, glycerine monoacrylic acid ester, glycerine monomethacrylic acid ester, N-methyloylacrylamide, N-methyloylmethacrylamide, or the like; vinyl alcohol or ether of vinyl alcohol such as vinyl methyl ether, vinyl ethyl ether and vinyl propyl ether, esters of compounds containing a carboxylic group with vinyl alcohol such as vinyl acetate, vinyl propionate and vinyl butyrate, acrylamide, methacrylamide, diacetone acrylamide, methyloyl compounds thereof, or the like; acid chlorides such as acrylic acid chloride and methacrylic acid chloride, homopolymers and copolymers containing a nitrogen atom or its heterocyclic ring such as vinyl pyridine, vinyl pyrrolidine, vinyl imidazole, ethyleneimine, or the like; polyoxyethylene compounds such as polyoxthylene polyoxypropylene, polyoxyethylene alkylamine, polyoxyethylene propylamine, polyoxyethylene alkylamide, polyoxypropylene alkylamide, polyoxyethylene nonyl phenyl ether, polyoxyethylene lauryl phenyl ether, polyoxyethylene stearyl phenyl ether, polyoxyethylene nonyl phenyl ester, or the like; celluloses such as methyl cellulose, hydroxyethyl cellulose, hydroxypropyl cellulose, or the like; and the like.

If a substance such as calcium phosphate which is soluble in acid or alkali is used as a dispersion stabilizer, the calcium phosphate or other substance is dissolved using acid such as hydrochloric acid, or the like, and calcium phosphate is then removed from the particles by rinsing with water. It may also be removed by enzymatic decomposition.

If a dispersant is used, the dispersant may be left on the surface of the toner. From the viewpoint of charging toner, it is preferred to remove it by performing at least one of an extension and crosslinking reaction, and washing.

In order to reduce the viscosity of the toner composition, a solvent may be used. The modified polyester resin (i) or prepolymer (A) is soluble in the solvent. The use of the solvent is preferred from the viewpoint that the particle size distribution is sharp. This solvent is preferably volatile and has a boiling point of less than 100° C. from the viewpoint of easy removal. Examples of the solvent include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, methyl isobutyl ketone, and the like. One of these solvents can be used either alone or in combination of two or more. In particular, aromatic solvents such as toluene, xylene, or the like and halogenated hydrocarbons such as methylene chloride, 1,2-dichloroethane, chloroform, carbon tetrachloride, or the like are preferred.

The amount of the solvent to be used is usually 0 part by weight to 300 parts by weight, is preferably 0 part by weight to 100 parts by weight, and is more preferably 25 parts by weight to 70 parts by weight relative to one 100 parts by weight of the prepolymer (A). If the solvent is used, at least one of an extension and crosslinking reaction, is performed, and the solvent is then removed by heating at normal pressure or under reduced pressure.

Reaction time for at least one of the extension and crosslinking is selected according to the reactivity of the combination of the isocyanate group in the prepolymer (A) and the amine (B), and it is usually 10 minutes to 40 hours, and is preferably 2 hours to 24 hours. The reaction temperature is usually 0° C. to 150° C., and is preferably 40° C. to 98° C. A catalyst known in the art may also be used if required. Specific examples are dibutyl tin laurate, dioctyl tin laurate, and the like.

To remove the organic solvent from the obtained emulsification dispersant, the temperature of the whole system is gradually raised, and the organic solvent in the liquid drops is completely removed by evaporation. Alternatively, the emulsification dispersant is sprayed into a dry atmosphere to completely remove the water-insoluble organic solvent in the liquid drops and form toners, and aqueous dispersing agent is removed at the same time by evaporation. The dry atmosphere into which the emulsification dispersant is sprayed, is generally a heated gas such as air nitrogen, carbon dioxide or combustion gas, the gas flow being-heated to a temperature above the boiling point of the highest-boiling solvent used.

The desired product quality can be obtained in a short time by using a spray dryer, belt dryer, rotary kiln, or the like. If the particle size distribution during emulsification dispersion is large, and washing or drying are performed while maintaining this particle size distribution, the particle size distribution can be adjusted a desired particle size distribution by classifying.

The classifying is performed by removing particles from the liquid using a cyclone, decanter, centrifugal separation, or the like. The classifying can of course be performed after obtaining the dry powder. It is preferred from the viewpoint of efficiency to perform this in the liquid. The toners that are not necessary or coarse toners can be recycled to the melt kneading step to form desirable toners. In that case, the toners that are not nor coarse toners may be in wet.

It is preferred that the dispersing agent is removed from the obtained dispersion as much as possible, and this is preferably done at the same time as the classifying described above.

The obtained powder of the toners after drying may be mixed with other particles such as release agent, charge control substance, fluidizer, fine particles of coloring agent, and the like, fixed on the surface by giving a mechanical shock to the mixed powder and melted to prevent separation of the other particles from the surface of the obtained the mixture of the particles.

Specific methods for doing this are giving an impact to the mixture include: into high speed rotating blades, or by introducing the mixture into a high-speed gas flow, and accelerating so that the particles collide with each other or the complex particles are made to strike a suitable impact plate. The device used for this purpose may be an angmill (available from Honkawa Micron) or i-mill (available from Japan Pneumatic) which are modified to reduce the air pressure upon pulverizing, a hybridization system (available from Nara Machine Laboratories), a krypton system (available from Kawasaki Heavy Industries), an automatic mortar, or the like.

(Developer)

If the toner of the present invention is used in a double-component developer, it may be used in combination with a magnetic carrier, and the blending ratio of the carrier and the toner in the developer is preferably 1 part by weight to 10 parts by weight of the toner, relative to 100 parts by weight of the carrier.

The magnetic carrier may be any of those known in the art. Examples of the magnetic carrier include iron powder, ferrite powder, magnetite powder, a magnetic resin carrier, or the like, each of which has a particle diameter of approximately 20 μm 200 μm.

The carrier may be coated with coating material such as a resin. Examples of such coating materials are amino resins such as urea-formaldehyde resin, melamine resin, benzoguanamine resin, urea resin, polyamide resin, epoxy resin, and the like. Other examples are polyvinyl and polyvinylidene resins such as acrylic resins, polymethyl methacrylate resin, polyacrylonitrile resin, polyvinyl acetate resin, polyvinyl alcohol resin, polyvinyl butyral resin, polystyrene resins such as styrene-acryl copolymer resin, halogenated olefin resins such as polyvinyl chloride, polyester resins such as polyethylene terephthalate resin and polyethylene terephthalate resin, polycarbonate resins, polyethylene resins, polyvinyl fluoride resin, polyvinylidene fluoride resin, polytrifluoro ethylene resin, polyhexafluoropropylene resin, copolymers of vinylidene fluoride with acrylic monomers, copolymers of vinylidene fluoride with vinyl fluoride, fluoroterpolymers such as the terpolymer of tetrafluoroethylene, vinylidene fluoride and a non-fluoride monomer, silicone resins, and the like.

An electroconducting powder or the like may also be contained in the coating material if necessary. Examples of electroconducting powders are metal powders, carbon black, titanium oxide, tin oxide, zinc oxide, and the like. These electroconducting powders preferably have an average particle diameter of 1 μm or less. If the average particle diameter is more than 1 μm, it is difficult to control electrical resistance.

The toner of the present invention may also be used as a single-component magnetic toner which does not use a carrier. The toner of the present invention may also be used as a non-magnetic toner.

(Image-Forming Process and Developing Device (Image-Developer))

There is no particular limitation on the image-forming process of the present invention provided that it uses the aforesaid developer. In particular, if the developer of the present invention is used in a developing device (image-developer) fitted with a magnetic roller, in which the following devices is used to increase the magnetic brush density, most of the problems involved in using a image-forming process where the magnetic brush density is increased can be resolved, and a high-quality image which is stable with time can be obtained.

As previously described, in the image-forming process where the magnetic brush density is increased to prevent abnormal images such as image omission at rear end, image deterioration with time compared to the initial image is particularly apparent. A relative comparison of the torque difference over time acting on the magnetic brush is first made for a developing device (image-developer) using a image-forming process which increases the magnetic brush density equipped with a magnetic roller described in the present invention, and for a developing device (image-developer) using a magnetic roller which did not increase the magnetic brush density. FIG. 7 shows the measurement results of this torque difference. For this measurement, an ordinary torque measuring device is connected to the rotating gear part at one end of the magnetic roller, and the torque value with time was measured by a Data Logger NR2000 (available from KEYENCE CORPORATION). It is thus found out that in the case of the developing device (image-developer) equipped with the magnetic roller of the present invention, the effect of torque value with time, increased more compared to the initial period, i.e., the stress given on the magnetic brush increased and due to this, the image quality with time deteriorated compared to the initial period.

To resolve this deterioration with time, it is important that the toner used for the developer has a specific particle diameter distribution of the toner and formation. It is found out that the problem could be resolved by using the toner of the present invention, in the other words, by arranging that, in the original toner, the ratio (Dv/Dn) and the circularity on average of the toner are within the ranges defined by the present invention.

The structure of the developing device (image-developer) used in a preferred image-forming process according to the present invention will now be described referring to FIG. 9.

A development roller 41 which serves as the developer-bearing member is disposed near a photoconducting drum 1 which serves as a latent electrostatic image-bearing member. A development region is provided in the mutually adjacent parts of the development roller 41 and the photoconductor drum 1. The aforesaid development roller 41 is provided with a development sleeve 43 comprised of a non-magnetic body such as aluminium, brass, stainless steel or an electroconducting resin formed into a cylindrical shape which is rotated clockwise by a rotating drive mechanism (not shown in the figure).

A magnetic roller 44 which generates a magnetic field and stands the developer upwards so as to form magnetic brushes on the surface of the development sleeve 43, is provided such that it is fixed inside the development sleeve 43. The carrier forming the developer then forms a chain-shaped brush on the development sleeve 43 along the magnetic force lines generated from the magnetic roller body 44, and charged toner adheres to this chain-shaped carrier so as to form magnetic brushes. The magnetic brushes thus formed is transported in the same direction as the development sleeve 43 together with the rotary motion of the development sleeve 43, namely, in a clockwise direction. A doctor blade 45 which controls the height of the magnetic brush of the developer chain, i.e., controls the developer amount, is installed in the upstream of the developing region in the developer transport direction, i.e., the clockwise direction. A screw 47 which attracts the developer in a developer casing 46 into the development roller 41 while stirring, is installed at the vicinity of the development roller 41.

Figure 10:
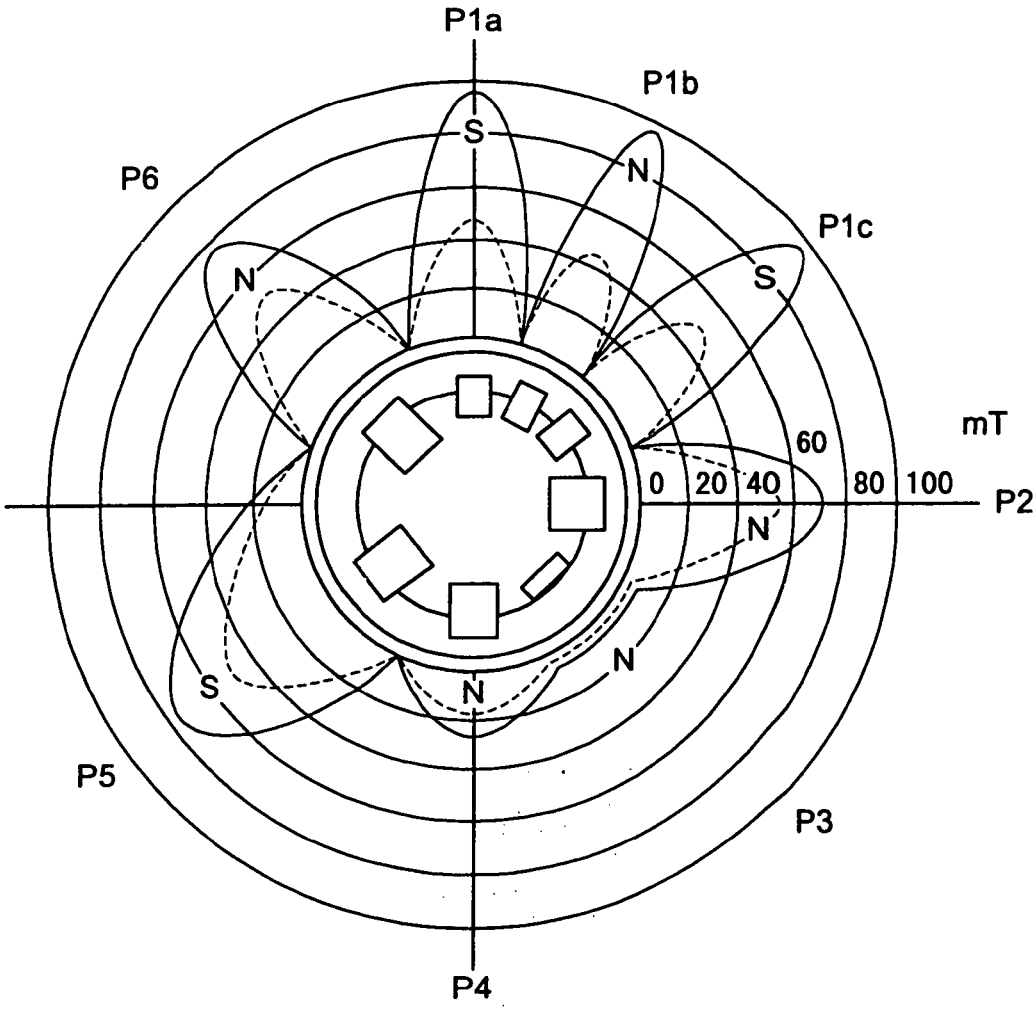
FIG. 10 is a view showing an example of the distribution of magnetic pole.

The magnetic roller body 44 is provided with plural magnetic poles. Specifically, as shown in FIG. 10, these poles comprise a developing main magnetic pole P1b which forms the developer into magnetic brushes in the developing region, auxiliary magnetic poles P1a and P1c which have different polarity from the developing main magnetic force, a magnetic pole P4 for attracting the developer on the development sleeve 43, magnetic poles P5 and P6 which transport the developer which has been attracted on the development sleeve 43 to the developing region, and magnetic poles P2 and P3 which transport developer in the region after development. These magnetic poles, P1b, P1a, P1c, P4, P5, P6, P2, and P3 are disposed in the radial direction in the development sleeve 43. This magnetic roller 41 comprises an eight-pole magnet, but to improve attracting properties and black solid image tracking properties, the number of magnetic poles may be further increased to 10 or 12 between the pole P3 and the doctor blade 45.

In this aspect of the present invention, as shown in FIG. 10, the above set of developing main magnetic poles P1s may comprise magnets having a small transverse cross-section together with P1a, P1b, P1c. When the transverse cross-section is small, the magnetic force generally becomes weak. If the magnetic force of the development roller surface becomes too small, the force holding the carrier is no longer sufficient in order that carriers may be disposed onto the photoconductor (latent electrostatic image bearing member). To counteract this, these magnets may be manufactured from a rare earth metal alloy which is strongly magnetic. An iron neodymium boron alloy magnet (FeNdB bond, which is a typical example of these rare earth metal alloy magnets, has a strength of 358 kJ/m$^3$ in terms of maximum energy integral, and an iron neodymium boron metal alloy bond magnet has a strength of about 80 kJ/m$^3$ in terms of maximum energy integral. Due to this, it is possible to maintain a higher magnetic force than the ferrite magnets or ferrite bond magnets usually used-which have a maximum energy integral of around 36 kJ/m$^3$ or around 20 kJ/m$^3$. Thus, it is now possible to maintain the magnetic force on the development roller even if a magnet with small transverse cross-section is used. In addition to the above, a samarium bond metal alloy magnet can also be used to maintain the magnetic force. Due to the structure of the aforesaid magnets, the half-value width of the main magnetic pole P1b decreases, and the nip can therefore be narrowed. In this case, as the nip of the magnetic brush which contacts or contacts the photoconductor (latent electrostatic image bearing member) becomes narrower, toner drift does not occur so easily at the magnetic brush tip, and "image omission at rear end" can therefore be reduced. Also, due to the auxiliary magnetic poles P1a, P1c, the magnetic force lines of the main magnetic pole P1b become more concentrated, and as the magnetic force density attenuation factor in the normal direction of the nip part increases, a high-density magnetic brush is formed in the nip. Hence, the magnetic brushes are not scattered in the longitudinal direction in the nip but becomes very uniform, and "image omission at rear end" over the whole region in the longitudinal direction can be reduced.

Specifically, if the drum diameter of the photoconductor drum 1 is 60 mm, the sleeve diameter of the development sleeve 43 is 20 mm, and the auxiliary magnetic poles P1a, P1c on both sides of the main magnetic pole P1b have an angle less than 30°, specifically 25°, as shown in FIG. 10, the half-value width of the main magnetic pole P1b is less than 22°, specifically 16°. Also, whereas the magnetic flux density on the development sleeve surface of the main magnetic pole measured by a Gauss Meter (HGM-8300: available from the ADS) and A1 axial probe (available from the ADS) was 117 mT, the magnetic flux density at a position 1 mm distant from the development sleeve surface was 54.4 mT, meaning that the attenuation rate was 53.5%.

Figure 9:
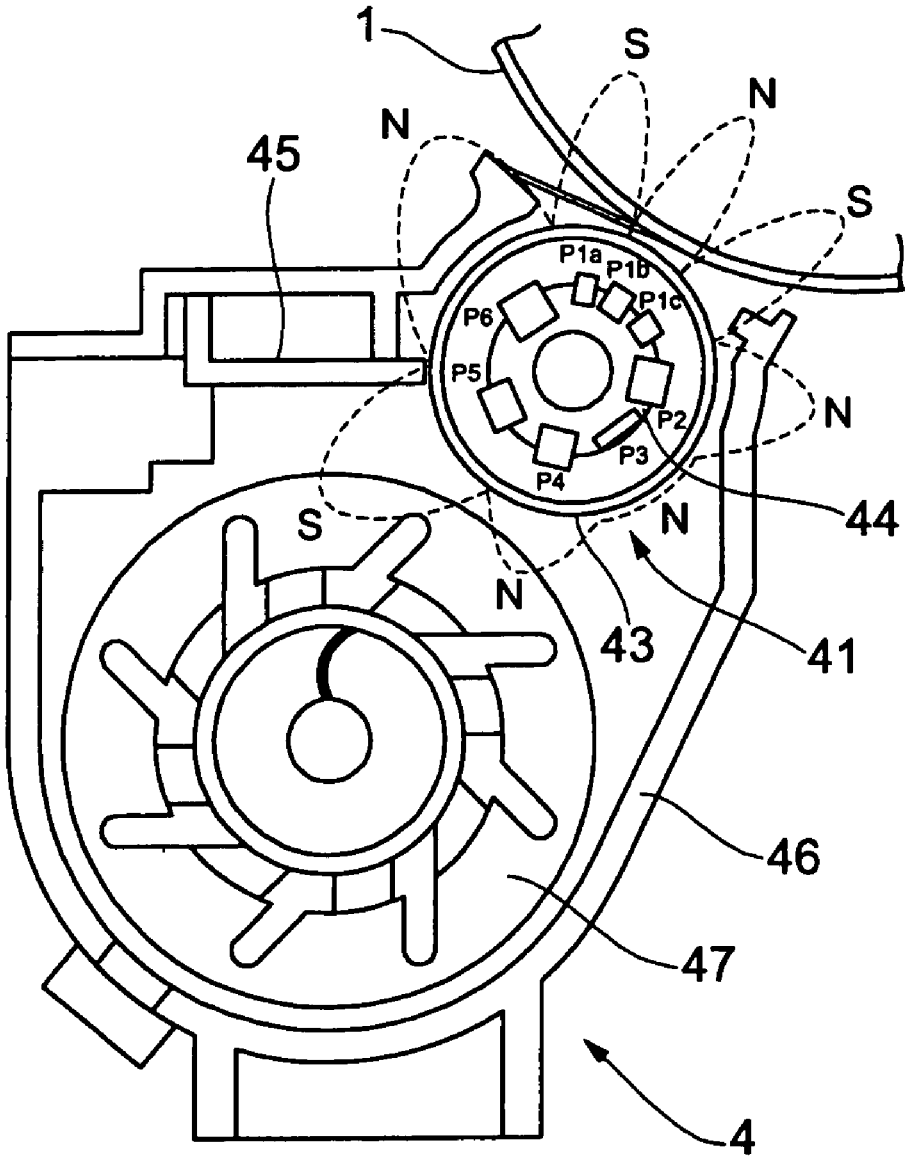
FIG. 9 is a cross sectional view showing an example of a developing device used in Examples Bs.

In FIGS. 9 and 10, an example was described using auxiliary magnetic poles. If the main magnetic pole P1b is used alone without the auxiliary magnetic poles, according to experimental results obtained by the inventors of the present invention, as the magnetic force lines entering the transport magnetic poles P2 to P6 are increased, the magnetic brush is formed densely and image omission at rear end can be sufficiently reduced if the magnetic flux density attenuation rate is 40% or more in the normal direction in the nip part. Also, according to experimental results obtained by the inventors of the present invention, regarding the half-value width of the main magnetic pole, the magnetic brushes are formed densely and image omission at rear end can be sufficiently reduced, if the half-value width of this main magnetic pole is less than 22°.

Herein, magnetic flux densities were measured for the FeNdB bond magnetic roller (diameter 20 mm). The results of comparison with an ordinary magnetic roller of ferrite or the like which has a weak magnetism are shown in the following (a) and (b) in Table 2. These magnetic roller measurements were performed using the above TS-10A probe (available from the ADS) and Gauss Meter (HGM-8900: available from the ADS). The position of the Hall probe for measuring magnetic flux density in the normal direction and tangential direction was set to 0.5 mm from the sleeve surface. In the magnetic rollers in Table 2, P3 has the main functions of returning the developer to the unit. As its magnetic flux density is extremely small, it is not shown.

TABLE 2

| (a) FeNdB bond magnetic roller | P1a | P1b | P1c | P2 | P4 | P5 | P6 |
|---|---|---|---|---|---|---|---|
| Magnetic flux density (mT) | 87 | 69.8 | 77.7 | 54 | 30 | 72.8 | 62.2 |
| Half-value center angle | 337.7 | 0 | 22.6 | 59.1 | 147.8 | 203 | 287.6 |
| Half-value width | 17.8 | 13.4 | 17.1 | 29.7 | 84.9 | 42.2 | 46.6 |
| Magnetic pole | S | N | S | N | N | S | N |

| (b) Prior art magnetic roller | P1a | P2 | P4 | P5 | P6 |
|---|---|---|---|---|---|
| Magnetic flux density (mT) | 89.2 | 57.5 | 21.1 | 63.5 | 71.9 |
| Half-value center angle | 0 | 65.8 | 157.8 | 211.4 | 295.5 |
| Half-value width | 47.6 | 37.2 | 29.3 | 38 | 49.7 |
| Magnetic pole | S | N | N | S | N |

If the magnetic roller having the structure shown in (a) of Table 2 is actually used in the developing device (image-developer) part of the image-forming apparatus, image omission at rear end and the zigzag shape of the image are suppressed. In other words, by narrowing the half-value width of the main magnetic pole, appearance and disappearance of a short magnetic brush can be obtained so that the development nip is narrowed, drift to the base of the toner at the magnetic brush tip is reduced to very small amounts, and appearance and disappearance of the magnetic brush is uniform in the longitudinal direction of the sleeve, so zigzag shapes and white dropout at the image rear end do not easily occur.

Figure 11:
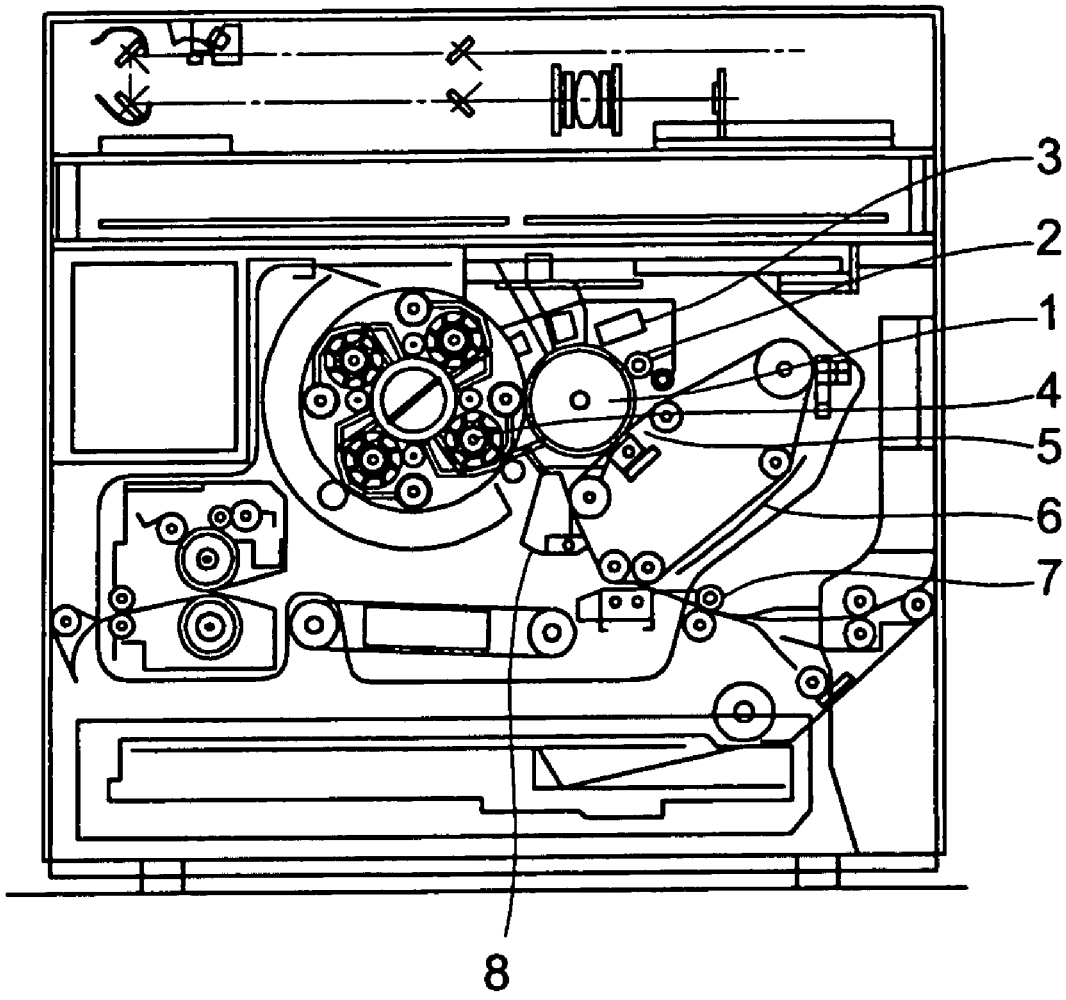
FIG. 11 is a cross sectional view showing an example of a color image-forming apparatus using the process for developing of the present invention.

FIG. 11 shows an example of a color image-forming apparatus, which is an example of the image-forming apparatus according to the present invention. A charging device (charger) 2 which charges the surface of a photoconductor drum 1 (latent electrostatic image bearing member) by a charging roller or the like, an exposure device (light-irradiator) 3 which forms a latent image on the uniformly charged surface of the photoconductor drum (latent electrostatic image bearing member) by a laser beam or the like, a developing device (image-developer) (image-developer) 4 which forms a toner image by making charged toner disposed onto the latent image on a photoconductor drum (latent electrostatic image bearing member)1, a transfer device (transfer) 5 which transfers the toner image formed on the photoconductor drum 1 by a transfer belt or transfer roller, charger, or the like, to a recording paper (recording medium) 6, a cleaning device (cleaner) 7 which removes toner remaining on the photoconductor drum 1 after transfer, and a discharge device 8 which discharges remaining potential on the photoconductor drum 1, are arranged in that sequence around the photoconductor drum 1 which is the latent image-bearing member. The developing device (image-developer) (image-developer) has a revolver structure comprising a Bk image-developer, C image-developer, M image-developer and Y image-developer. In this structure, the photoconductor drum 1 whereof the surface is uniformly charged by the charging roller of the charging device 2, forms an latent electrostatic image by the exposure device 3, and a toner image is formed by the developing device (image-developer) 4. This toner image is transferred by the transfer device 5 from the surface of the photoconductor drum 1 to a recording paper (recording medium) which is transported by a paper feed tray (not shown). Subsequently, the toner image on the recording paper is fixed on the recording paper by a image-fixing device. At the same time, toners remaining on the photoconductor drum which are not transferred is recovered by the cleaning device 7. The photoconductor drum from which residual toner is removed, is initialized by the discharge lamp (discharging device) 8, and prepared for the next image-forming process.

The image-forming apparatus having the structure utilizes the image-forming process of the present invention, and can therefore maintain high image quality with excellent fine line and dot reproducibility without abnormal images such as image omission at rear end over long periods. Further, soiling inside and outside the apparatus due to toner scattering which accompanies toner deterioration with time, can be prevented. In the case of color image-forming process, high image quality with excellent fine line and dot reproducibility without abnormal images such as image omission at rear end can be maintained over long periods, and image quality deterioration due to color mixing which accompanies toner deterioration with time, can be prevented.

(Image-Forming Process Cartridge)

The image-forming process cartridge of the present invention comprises the developer of the present invention, an image-developer configured to have a developer container, and to supply the developer of the present invention to a latent electrostatic image, so as to visualize the latent electrostatic image and form a toner image, and one of a latent electrostatic image support, a charger configured to charge a surface of the latent electrostatic image uniformly, and a cleaner configured to clean the surface of the: latent electrostatic image bearing member. The image-forming process cartridge is formed in one-piece construction, and is attachable to and detachable from an image-forming apparatus. The image-developer in the image-forming process cartridge of the present invention contains the developer of the present invention. The developer contains the toner for developing a latent electrostatic image of the present invention.

The image-forming process cartridge of the present invention exhibits satisfactory charging properties when incorporated in an image-forming apparatus. The image-forming process cartridge of the present invention also enables forming an image, on which few of the toners are weakly or inversely charged, and none of the toners are scattered, even after several tens of thousands of sheets are printed at high temperature and in high humidity.

Figure 12:
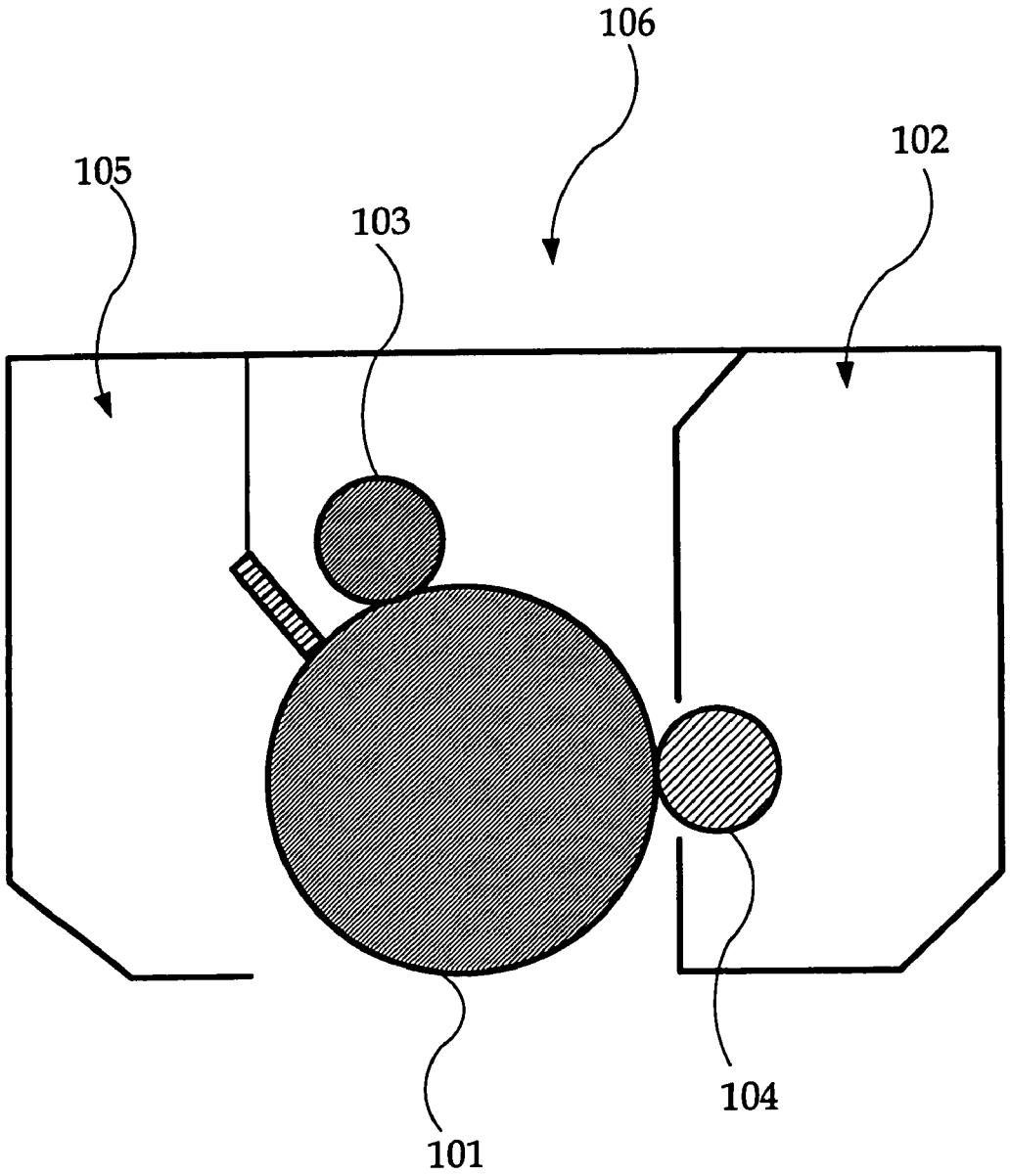
FIG. 12 is a schematic view showing an example of an image-forming process cartridge of the present invention.

FIG. 12 is a schematic diagram showing an example of the image forming process unit (process cartridge). The image forming process unit 106 includes a photoconductor drum 101 serving as the latent electrostatic image bearing member, a charge roller 103 serving as the charging device, a cleaning device 105 serving as the cleaning device, and a image-developer 102 serving as the image-developer. These components of the image forming process unit 106 constitute an integral structure that is attachable to and detachable from a printer main body. The image-developer 102 includes a development sleeve 104.

The present invention will now be described in more detail referring to the following examples. It should be understood that the present invention is not limited to the examples. In Example As, parts are referred to as "parts by weight."

EXAMPLE A-1

(Synthesis to Binder Resin)

724 parts of bisphenol A ethylene oxide dimolar adduct, 276 parts of isophthalic acid and 2 parts of dibutyl tin oxide were introduced into a reaction vessel equipped with a condenser, stirrer and nitrogen inlet tube, were reacted under normal pressure at 230° C. for 8 hours, were reacted again under a reduced pressure of 10-15 mmHg for 5 hours and cooled to 160° C., then 32 parts of phthalic anhydride was added and the reaction was continued for 2 hours. Next, the reaction mixture was cooled to 80° C., and 188 parts of isohorone diisocyanate was added in ethyl acetate and reacted for 2 hours to obtain a prepolymer (1) containing isocyanate. Next, 267 parts of the prepolymer (1) and 14 parts of isohorone diamine were reacted at 50° C. for 2 hours to obtain a urea-modified polyester resin (1) having a weight average molecular weight of 64000. In an identical manner to that of the above, 724 parts of bisphenol A ethylene oxide dimolar adduct and 276 parts of isophthalic acid were condensation polymerized at 230° C. for 8 hours, and then reacted under a reduced pressure of 10 mmHg to 15 mmHg for 5 hours to obtain a non-modified polyester resin (a) having a peak molecular weight of 5000. 200 parts of the urea-modified polyester resin (1) and 800 parts of the non-modified polyester resin (a) were dissolved in 2000 parts of ethyl acetate/MEK (1/1) mixed solvent, and stirred to obtain an ethyl acetate/MEK solution of the binder resin (1). This was dried under partial reduced pressure to isolate the binder resin (1). Tg was 62° C. and the acid value was 10.

(Preparation of Toner)

240 parts of an ethyl acetate/MEK solution of the aforesaid binder resin (1), 20 parts of pentaerythritol tetrabehenate (melting point: 81° C., melt viscosity: 25 cps) and 10 parts of carbon black were introduced into a beaker, and stirred at 12000 rpm at 60° C. by a TK homomixer to uniformly dissolve and disperse the ingredients. 706 parts of ion exchange water, 294 parts of a 10% suspension of hydroxyapatite (Japan Chemical Industries, Supertite 10) and 0.2 parts of a sodium dodceyl benzene sulfonate were introduced into the beaker, and uniformly dissolved. Next, the temperature was raised to 60° C., and the above toner material solution was introduced while stirring at 12000 rpm in the TK homomixer for 10 minutes.

Next, this mixed solution was transferred to a flask equipped with a stirring rod and thermometer, the temperature was raised to 98° C. to remove part of the solvent, then the temperature was returned to room temperature, the mixture was stirred at 12000 rpm in the same homomixer to change the toner shape from spherical, and the solvent was completely removed. Subsequently, the product was rinsed and dried, and graded by air power to obtain bases of toner particles. The volume average particle diameter (Dv) was 6.75 μm, the number average particle diameter (Dn) was 5.57 μm, and the ratio (Dv/Dn) was 1.21. Next, 0.5 parts of hydrophobic silica was added to 100 parts of the toners and mixed in a Henschel mixer to obtain the toner (1) of the present invention. Other detailed conditions and test results are shown in Tables 3 and 4.

EXAMPLE A-2

(Synthesis to Binder Resin)

In an identical manner to that of Example A-1, 334 parts of bisphenol A ethylene oxide bimolar adduct, 274 parts of isophthalic acid and 20 parts of anhydrous trimellitic acid were condensation polymerized, and reacted with 154 parts of isohorone diisocyanate to obtain a prepolymer (2). Next, 213 parts of the prepolymer (2), 9.5 parts of isohorone diamine and 0.5 parts of dibutylamine were reacted in the same way as that of Example A-1 to obtain a urea-modified polyester resin (2) having a weight average molecular weight of 79000. 200 parts of the urea-modified polyester resin (2) and 800 parts of the non-modified polyester resin (a) were dissolved in 2000 parts of ethyl acetate/MEK (1/1) mixed solvent, and stirred to obtain an ethyl acetate of the binder resin (2). This was dried under partial reduced pressure to isolate the binder resin (2). The peak molecular weight was 5000, Tg was 62° C. and the acid value was 10.

(Toner Preparation)

The identical procedure as that of Example A-1 were followed except that the binder resin (1) was replaced by the binder resin (2), and the dissolution temperature and dispersion temperature were changed to 50° C. to obtain the base of toner particle (2) of the present invention. Then, 1.0 parts of the zinc salt of a salicylic acid derivative was added as a charge control substance, and stirred in a heated atmosphere to make the charge control substance present on the surface of the toner. The volume average particle diameter (Dv) of the base of toner particle was 5.5 μm, the number average particle diameter (Dn) of the base of toner particle was 4.88 μm, and the ratio (Dv/Dn) was 1.14. Next, 1.0 parts of hydrophobic silica and 0.5 parts of hydrophobic titanium oxide were mixed with 100 parts of the toners in a Henschel mixer to obtain the toner (2) of the present invention. Other detailed conditions and test results are shown in Tables 3 and 4.

EXAMPLE A-3

(Binder Resin Synthesis)

30 parts of the urea-modified polyester resin (1) and 970 parts of the non-modified polyester resin (a) were dissolved in 2000 parts of ethyl acetate/MEK (1/1) mixed solvent, and stirred to obtain an ethyl acetate/MEK solution of the binder resin (3). This was dried under partial reduced pressure to isolate the binder resin (3). The peak molecular weight was 5000, Tg was 62° C. and the acid value was 10.

(Preparation of Toner).

The toner (3) of the present invention was obtained in an identical manner to that of Example A-2, except that the binder resin (2) was replaced by the binder resin (3), and the coloring agent was changed to 8 parts of carbon black. The volume average particle diameter (Dv) of the base of toner particle was 6.82 μm, the number average particle diameter (Dn) of the base of toner particle was 6.11 μm, and the ratio (Dv/Dn) was 1.12. Other detailed conditions and test results are shown in Tables 3 and 4.

EXAMPLE A-4

(Binder Resin Synthesis)

500 parts of the urea-modified polyester resin (1) and 500 parts of the non-modified polyester resin (a) were dissolved in 2000 parts of ethyl acetate/MEK (1/1) mixed solvent, and stirred to obtain an ethyl acetate/MEK solution of the binder resin (4). This was dried under partial reduced pressure to isolate the binder resin (4). The peak molecular weight was 5000, Tg was 62° C. and the acid value was 10.

(Preparation of Toner)

The toner (4) of the present invention was obtained in an identical manner to that of Example A-1, except that the binder resin (1) was replaced by the binder resin (4), and 8 parts of carbon black was used as material for the toner. The volume average particle diameter (Dv) of the base of toner particle was 4.89 μm, the number average particle diameter (Dn) of the base of toner particle was 4.45 μm, and the ratio (Dv/Dn) was 1.10. Other detailed conditions and test results are shown in Tables 3 and 4.

EXAMPLE A-5

(Synthesis to Binder Resin)

750 parts of the urea-modified polyester resin (1) and 250 parts of the non-modified polyester resin (a) were dissolved in 2000 parts of ethyl acetate/MEK (1/1) mixed solvent, and stirred to obtain an ethyl acetate/MEK solution of the binder resin (5). This was dried under partial reduced pressure to isolate the binder resin (5). The peak molecular weight was 5000, Tg was 62° C. and the acid value was 10.

(Preparation of Toner)

The toner (5) of the present invention was obtained in an identical manner to that of Example 1, except that the binder resin (1) was replaced by the binder resin (5). The volume average particle diameter (Dv) of the base of toner particle was 5.95 μm, the number average particle diameter (Dn) of the base of toner particle was 5.21 μm, and the ratio (Dv/Dn) was 1.14. Other detailed conditions and test results are shown in Tables 3 and 4.

EXAMPLE A-6

(Synthesis to Binder Resin)

850 parts of the urea-modified polyester resin (1) and 150 parts of the non-modified polyester resin (a) were dissolved in 2000 parts of ethyl acetate/MEK (1/1) mixed solvent, and stirred to obtain an ethyl acetate/MEK solution of the binder resin (6). This was dried under partial reduced pressure to isolate the binder resin (6). The peak molecular weight was 5000, Tg was 62° C. and the acid value was 10.

(Preparation of Toner)

The toner (6) of the present invention was obtained in an identical manner to that of Example 1, except that the binder resin (1) was replaced by the binder resin (6). The volume average particle diameter (Dv) of the base of toner particle was 3.90 μm, the number average particle diameter (Dn) of the base of toner particle was 3.38 μm, and the ratio (Dv/Dn) was 1.15. Other detailed conditions and test results are shown in Tables 3 and 4.

EXAMPLE A-7

(Binder Resin Synthesis)

724 parts of bisphenol A ethylene oxide bimolar adduct and 276 parts of terephthalic acid were condensation polymerized under atmospheric pressure at 230° C. for 2 hours, and reacted under a reduced pressure of 10 mmHg to 15 mmHg for 5 hours to obtain a non-modified polyester resin (b) having a peak molecular weight of 800. 200 parts of the urea-modified polyester resin (1) and 800 parts of the non-modified polyester resin (b) were dissolved in 2000 parts of ethyl acetate/MEK (1/1) mixed solvent, and stirred to obtain an ethyl acetate/MEK solution of the binder resin (7). This was dried under partial reduced pressure to isolate the binder resin (7). Tg was 45° C.

(Preparation of Toner)

The toner resin (7) was obtained in an identical manner to that of Example 1, except that the binder resin (1) was replaced by the binder resin (7). The volume average particle diameter (Dv) of the base of toner particle was 5.22 μm, the number average particle diameter (Dn) of the base of toner particle was 4.50 μm, and the ratio (Dv/Dn) was 1.16. Other detailed conditions and test results are shown in Table 3.

COMPARATIVE EXAMPLE A-1

(Binder Resin Synthesis)

354 parts of bisphenol A ethylene oxide dimolar adduct and 166 parts of isophthalic acid were condensation polymerized using 2 parts of dibutyl tin oxide as catalyst to obtain a comparison binder resin (1) having a peak molecular weight of 4000. Tg of the comparison binder resin (1) was 57° C.

100 parts of the aforesaid comparison binder resin (1), 200 parts of ethyl acetate solution and 10 parts of carbon black were introduced into a beaker, and stirred at 12000 rpm at 50° C. by a TK homomixer to uniformly dissolve and disperse the ingredients. Next, the ingredients were transformed into a toner in the same way as in Example A-1 to obtain a comparison toner (1) of volume average particle diameter of 6 μm. The volume average particle diameter (Dv) of the base of toner particle was 7.51 μm, the number average particle diameter (Dn) of the base of toner particle was 6.05 μm, and the ratio (Dv/Dn) was 1.24. Other detailed conditions and test results are shown in Tables 3 and 4.

COMPARATIVE EXAMPLE A-2

(Binder Resin Synthesis)

343 parts of bisphenol A ethylene oxide dimolar adduct, 166 parts of isophthalic acid and 2 parts of dibutyl tin oxide were introduced into a reaction vessel equipped with a condenser, stirrer and nitrogen inlet tube, reacted under atmospheric pressure at 230° C. for 8 hours, reacted under a reduced pressure of 10 mmHg to 15 mmHg for 5 hours and cooled to 80° C., then 14 parts of toluene diisocyanate was introduced in toluene and reacted 110° C. for 5 hours, and the solvent was removed to obtain a urethane-modified polyester resin having a weight average molecular weight of 98000. 363 parts of bisphenol A ethylene oxide dimolar adduct and 166 parts of isophthalic acid were condensation polymerized as in Example A-1 to obtain a non-modified polyester resin having a peak molecular weight of 3800 and an acid value of 7. 350 parts of the aforesaid urethane-modified polyester resin and 650 parts of non-modified polyester resin were dissolved in toluene, and after stirring, the solvent was removed to give the comparison binder resin (2).

Tg of the comparison binder resin (2) was 58° C.

(Preparation of Toner)

100 parts of the comparison binder resin (2) and 8 parts of carbon black were converted to toner by the following method. First, after preliminary mixing using a Henschel mixer, the mixture was kneaded in a continuous kneader. Next, after pulverizing in a jet crusher, the product was classified in an air current classifier to obtain toners. Next, 1.0 parts of hydrophobic silica and 0.5 parts of hydrophobic titanium oxide were mixed with 100 parts of toners using a Henschel mixer to obtain the comparison toner (2). The volume average particle diameter (Dv) of the base of toner particle was 6.50 μm, the number average particle diameter (Dn) of the base of toner particle was 5.50 μm, and the ratio (Dv/Dn) was 1.18. Other detailed conditions and test results are shown in Tables 3 and 4.

COMPARATIVE EXAMPLE A-3

(Synthesis to Binder Resin)

354 parts of bisphenol A ethylene oxide dimolar adduct and 166 parts of isophthalic acid were condensation polymerized using 2 parts of dibutyl tin oxide as catalyst to obtain a comparison binder resin (3) having a peak molecular weight of 12000. Tg was 62° C., and the acid value was 10.

(Toner Manufacturing Example)

100 parts of the aforesaid comparison binder resin (3), 200 parts of ethyl acetate and 4 parts of copper phthalocyanine blue were introduced in a beaker, and stirred at 12000 rpm in a TK homomixer at 50° C. to uniformly disperse and dissolve the ingredients and obtain a comparison toner material solution. Next, this was converted to a toner in the same way as in Example A-5 to obtain a comparison toner (3). The volume average particle diameter (Dv) of the base of toner particle was 6.12 μm, the number average particle diameter (Dn) of the base of toner particle was 4.64 μm, and the ratio (Dv/Dn) was 1.32. Other detailed conditions and test results are shown in Tables 3 and 4.

COMPARATIVE EXAMPLE A-4

(Preparation of Toner)

A comparison toner (4) was prepared under identical conditions to those of Example A-1, except that in the process for converting the form of the base of toner particle prepared in Example A-1, after removing portion of the solvent and returning to room temperature, the toner formation was changed from spherical while stirring at 18000 rpm using the same homomixer. Other detailed conditions and test results are shown in Tables 3 and 4.

COMPARATIVE EXAMPLE A-5

(Preparation of Toner)

A toner was prepared in a completely identical way to that of Example A-1, except that 0.2 parts of hydrophobic silica was mixed with 100 parts of the base of toner particle prepared in Example A-1 using a Henschel mixer to obtain the comparison toner (5). Other detailed conditions and test results are shown in Tables 3 and 4.

[Measurement of Properties]

<Particle Diameter (Volume Average Particle Diameter (Dv), Number Average Particle Diameter (Dn)>

The particle diameter (volume average particle diameter, number average particle diameter) was measured using a Coulter Electronics Coulter Counter model TA-II.

Using the aforesaid measuring device, an interface (Nikka Machines) and a PC 9801 personal computer (available from NEC) to output the number distribution and volume distribution were connected, and a 1% NaCl aqueous solution was prepared using. primary purity sodium chloride.

The measurement was performed by dispersing a surfactant, preferably 0.1 ml to 5 ml of an alkylbenzene sulfonate, as dispersant in 100 ml to 150 ml of the aforesaid electrolyte solution, adding 2 mg to 20 mg of the measurement sample, and performing dispersion treatment for approximately 1 to 3 minutes in an ultrasonic disperser.

100 ml to 200 ml of the electrolyte solution was introduced into another beaker, and the aforesaid sample dispersion was added to a predetermined concentration to give a suspension.

Using this suspension, the particle size distribution of particles in the range 2 μm to 40 μm was measured based on number using a 100 μm aperture as the aperture by the above Coulter Counter TA-II, the volume distribution and number distribution of particles in the range 2 μm to 40 μm were computed, and the weight average particle diameter (D4: taking the median value of each channel as the representative value for the channel) based on weight calculated from the volume distribution, was obtained.

<Measurement of Circularity>

The optical detection band method was used, wherein the particle-containing suspension (using the same suspension as that prepared for the above particle size measurement) was passed through a photographic detection band on a plate, and the particle images optically were detected/analyzed with a CCD camera.

This value can be measured as he circularity on average by a flow type particle image analyzer FPIA-1000 (To a Medical Electronics). Specifically, the measurement was performed by adding 0.1 ml to 0.5 ml of an alkylbenzene sulfonate surfactant as a dispersing agent to 100 ml to 150 ml of water from which solid impurities in the container had been previously removed, and then adding approximately 0.1 g to 0.5 g of the measurement sample.

The suspension in which the sample was dispersed was subjected to dispersion treatment for approximately 1 minute to 3 minutes by an ultrasonic disperser, and the toner formation was measured by the above apparatus at a dispersion concentration of 3000 to 10000 number/μl.

<Content of Particles Having Diameter of 0.6 μm to 2.0 μm>

Using the same suspension as that prepared for the above particle size measurement, the toner distribution was measured under the same conditions as those used for circularity by the same flow type particle image analyzer FPIA-1000 (Toa Medical Electronics) as that used for the circularity measurement, and the proportion of particles having a particle having a diameter of 0.6 μm to 2.0 μm was computed.

<SF-1>

Images of toners of 2 μm or more magnified 1000 times by a Hitachi Laboratories FE-SEM (S-800) were sampled at 100 frames, and this image information was input via the interface for example to a Thermo Nicolet Inc. image analyzer (Luzex III) where it was analyzed.

[Test Methods]

<Image Density>

The density of the image part was measured by a X-RiTe938.

<Toner Deposition on Background of the Image>

The density of the background part was measured by a X-RiTe938.

<Filming>

The presence or absence of filming of the toner on the development roller surface was visually observed.

○: No filming, x: Filming

<Lower Image-Fixing Temperature Limit>

Ricoh Company Ltd.'s type 6200 paper was set in a Copier IPSIO420 (produced by Ricoh Company Ltd.) with a modified image-fixing part using a Teflon roller as image-fixing roller, and a transfer test was performed. The lower image-fixing temperature limit was taken as the image-fixing roller temperature at which 70 or more of the image density remained after scratching the fixed image on a pad.

<Hot Offset Temperature (HOT)>

Image-fixing was evaluated in the same way as the aforesaid lower image-fixing temperature limit, and the presence or absence of hot offset on the fixed image was visually evaluated. The hot offset temperature was taken as the image-fixing roller temperature at which hot offset appeared.

TABLE 3

| Toner Properties | | | | | | | |
|---|---|---|---|---|---|---|---|
| | | Particle size distribution | | | | | |
| | | Volume average particle | Number average particle | | Particles of 0.6-0.2 μm | Toner shape | |
| | Toner No. | diameter Dv (μm) | diameter Dn (μm) | Ratio (Dv/Dn) | (% by number) | Circularity on average | SF-1 |
| Ex. A-1 | Toner 1 | 6.75 | 5.57 | 1.21 | 5.3 | 0.948 | 142 |
| Ex. A-2 | Toner 2 | 5.54 | 4.88 | 1.14 | 7.2 | 0.980 | 115 |
| Ex. A-3 | Toner 3 | 6.82 | 6.11 | 1.12 | 4.9 | 0.966 | 133 |
| Ex. A-4 | Toner 4 | 4.89 | 4.45 | 1.10 | 10.2 | 0.976 | 125 |
| Ex. A-5 | Toner 5 | 5.95 | 5.21 | 1.14 | 11.3 | 0.950 | 138 |
| Ex. A-6 | Toner 6 | 3.90 | 3.38 | 1.15 | 14.5 | 0.987 | 108 |
| Ex. A-7 | Toner 7 | 5.22 | 4.50 | 1.16 | 5.9 | 0.974 | 120 |
| Comp. Ex. A-1 | Comp. Toner 1 | 7.51 | 6.05 | 1.24 | 8.0 | 0.955 | 144 |
| Comp. Ex. A-2 | Comp. Toner 2 | 6.50 | 5.50 | 1.18 | 7.7 | 0.934 | 143 |
| Comp. Ex. A-3 | Comp. Toner 3 | 6.12 | 4.64 | 1.32 | 10.3 | 0.960 | 128 |
| Comp. Ex. A-4 | Comp. Toner 4 | 5.66 | 4.67 | 1.21 | 20.1 | 0.940 | 155 |
| Comp. Ex. A-5 | Comp. Toner 5 | 6.75 | 5.57 | 1.21 | 5.3 | 0.948 | 142 |

| | Toner composition | | | | | |
|---|---|---|---|---|---|---|
| | External Additive 1 | | | External Additive 2 | | |
| | Composition | First order particle diameter (nm) | Addition amount (parts by weight) | Composition | First order particle diameter (nm) | Addition amount (parts by weight) |
| Ex. A-1 | Hydrophobic silica | 10 | 0.5 | — | — | — |
| Ex. A-2 | Hydrophobic silica | 10 | 1.0 | Titanium oxide | 10 | 0.5 |
| Ex. A-3 | Hydrophobic silica | 10 | 1.5 | Titanium oxide | 10 | 0.5 |
| Ex. A-4 | Hydrophobic silica | 30 | 2.0 | — | — | — |
| Ex. A-5 | Hydrophobic silica | 30 | 2.5 | Titanium oxide | 10 | 0.5 |
| Ex. A-6 | Hydrophobic silica | 120 | 5.0 | Hydrophobic silica | | 0.5 |
| Ex. A-7 | Titanium oxide | 10 | 1.0 | — | — | — |
| Comp. Ex. A-1 | Hydrophobic silica | 10 | 0.5 | — | — | — |
| Comp. Ex. A-2 | Hydrophobic silica | 10 | 1.0 | Titanium oxide | 10 | 0.5 |
| Comp. Ex. A-3 | Hydrophobic silica | 10 | 1.0 | Titanium oxide | 10 | 0.5 |
| Comp. Ex. A-4 | Hydrophobic silica | 10 | 0.5 | — | — | — |
| Comp. Ex. A-5 | Hydrophobic silica | 10 | 0.2 | — | — | — |

TABLE 4

| | | Test result | | | | | | | |
|---|---|---|---|---|---|---|---|---|---|
| | | Image density | | Background deposition | | Filming | Lower limit of | | |
| | Toner No. | At start | After 100,000 sheets | At start | After 100,000 sheets | After 100,000 sheets | image-fixing temperature (° C.) | Hot offset temperature (° C.) | Overall evaluation |
| Example A-1 | Toner 1 | 1.43 | 1.36 | 0.02 | 0.04 | ○ | 145 | 240 or more | ○ |
| Example A-2 | Toner 2 | 1.39 | 1.38 | 0.01 | 0.00 | ○ | 130 | 240 or more | ○ |
| Example A-3 | Toner 3 | 1.47 | 1.41 | 0.00 | 0.01 | ○ | 150 | 240 or more | ○ |
| Example A-4 | Toner 4 | 1.45 | 1.43 | 0.01 | 0.01 | ○ | 135 | 240 or more | ○ |
| Example A-5 | Toner 5 | 1.46 | 1.45 | 0.00 | 0.01 | ○ | 150 | 240 or more | ○ |
| Example A-6 | Toner 6 | 1.48 | 1.46 | 0.01 | 0.00 | ○ | 130 | 240 or more | ○ |
| Example A-7 | Toner 7 | 1.46 | 1.45 | 0.00 | 0.00 | ○ | 125 | 240 or more | ○ |
| Comp. Ex. A-1 | Comp. Toner 1 | 1.44 | 1.40 | 0.04 | 0.58 | ○ | 195 | 200 | X |
| Comp. Ex. A-2 | Comp. Toner 2 | 1.35 | 1.31 | 0.02 | 0.15 | X | 165 | 240 or more | X |
| Comp. Ex. A-3 | Comp. Toner 3 | 1.40 | 1.05 | 0.02 | 0.47 | X | 120 | 210 | X |
| Comp. Ex. A-4 | Comp. Toner 4 | 1.30 | 1.01 | 0.03 | 0.56 | X | 145 | 240 or more | X |
| Comp. Ex. A-5 | Comp. Toner 5 | 1.33 | 1.25 | 0.03 | 0.25 | X | 145 | 240 or more | X |

The toner for developing a latent electrostatic image according to the present invention comprises a specific amount of 0.3 parts by weight to 5.0 parts by weight of external additives mixed with 100 parts by weight of abase of toner particle having a specific particle size, particle size distribution and shape and a volume average particle diameter (Dv) of 3 μm to 7 μm, the ratio (Dv/Dn) of volume average particle size (Dv) to number average particle diameter (Dn) of 1.01 to 1.25, particle content having a particle diameter in the range 0.6 μm to 2.0 μm of 15% or less and circularity of 0.930 to 0.990 on average, so it has excellent developing stability, anti-filming properties and low temperature image-fixing properties, together with excellent hot offset properties, excellent charge stability and long life.

The present invention also provides a container which contains the toner, a developer which comprises the toner, an image-forming process using this developer, an image-forming apparatus, and an image-forming process cartridge.

Next, an example of a preferred image-forming process according to the present invention will be described.

EXAMPLES B-1 TO B-16 AND COMPARATIVE EXAMPLES B-1 TO B-6

[Image-Forming Apparatus]

In this example, using the developing device (image-developer) having the structure of FIG. 9, the half-value width of the main magnetic pole was 16° and the magnetic flux density attenuation rate was 53.5% as described above. Regarding other specific conditions, the drum diameter of the photoconducting drum 1 was 60 mm, the drum linear velocity was set to 240 mm/sec, the sleeve diameter of the development sleeve 43 was 20 mm, and the sleeve linear velocity was set to 600 mm/sec. Therefore, the ratio of the sleeve linear velocity to the drum linear velocity was 2.5. Also, the developing gap which is the distance between the photoconducting drum 1 and development sleeve 43 was 0.4 mm. The doctor blade which controls the developer amount on the development sleeve was set to 0.4 mm. The magnetic roller in the development sleeve was a FeNdB bond roller as described in Table 2.

[Developer]

Next, the toner, carrier and double-component developer comprising these ingredients used in the present invention will now be described. The toners used in Example Bs were manufactured by the polymerization method described above, and the toner was specifically manufactured by the following process.

-Synthesis of Organic Resin Particle Dispersion- 683 parts of water, 11 parts of the sodium salt of the sulfuric acid ester of methacrylic acid ethylene oxide adduct (ELEMINOL RS-30, Sanyo Chemical Industries, Ltd.), 83 parts of styrene, 83 parts of methacrylic acid, 110 parts of butyl acrylate and 1 part of ammonium persulphate were introduced into a reaction vessel provided with a stirrer and thermometer, and stirred at 400 rpm/min for 15 minutes to give a white emulsion. This was heated, the temperature in the system was raised to 75° C. and the reaction performed for 5 hours. Next, 30 parts of an aqueous solution of 1% ammonium persulphate was added, and the reaction mixture matured and 75° C. for 5 hours to obtain an aqueous dispersion of a vinyl resin (copolymer of styrene-methacrylic acid-butyl acrylate-sodium salt of the sulfuric acid ester of methacrylic acid ethylene oxide adduct), "particulate emulsion 1." The volume average particle diameter of particulate emulsion 1 measured by LA-920 was 105 nm. After drying part of "particulate emulsion 1" and isolating the resin, Tg of the resin was 59° C. and the volume average molecular weight was 150000.

-Preparation of Aqueous Phase- 990 parts of water, 83 parts of "particulate emulsion 1," 37 parts of a 48.5% aqueous solution of sodium dodecyl diphenylether disulfonic acid (ELEMINOL MON-7: Sanyo Chemical Industries, Ltd.) and 90 parts of ethyl acetate were mixed and stirred together to obtain a milky liquid. This was taken as "aqueous phase 1."

-Synthesis of Low Molecular Weight Polyester- 229 parts of bisphenol A ethylene oxide dimolar adduct, 529 parts of bisphenol A propylene oxide trimolar adduct, 208 parts of terephthalic acid, 46 parts of adipic acid and 2 parts of dibutyl tin oxide were placed in a reaction vessel equipped with a condenser, stirrer and nitrogen inlet tube, the reaction was performed under normal pressure at 230° C. for 8 hours, and under a reduced pressure of 10-15 mmHg for 5 hours, then 44 parts of anhydrous trimellitic acid was introduced into the reaction vessel, and the reaction performed at 180° C. under normal pressure for 2 hours to obtain "low molecular weight polyester 1." The "low molecular weight polyester 1" had a number average molecular weight of 2500, weight average molecular weight of 6700, Tg of 43° C. and acid value of 25.

-Synthesis of Polyester Prepolymer (Intermediate Polyester)-

682 parts of bisphenol A ethylene oxide dimolar adduct, 81 parts of bisphenol A propylene oxide dimolar adduct, 283 parts of terephthalic acid, 22 parts of anhydrous trimellitic acid and 2 parts of dibutyl tin oxide were placed in a reaction vessel equipped with a condenser, stirrer and nitrogen inlet tube, the reaction was performed under normal pressure at 230° C. for 8 hours, and then under a reduced pressure of 10 mmHg to 15 mmHg for 5 hours to obtain "intermediate polyester 1." The "intermediate polyester 1" had a number average molecular weight of 2100, weight average molecular weight of 9500, Tg of 55° C., acid value of 0.5 and hydroxyl value of 51.

Next, 410 parts of "intermediate polyester 1," 89 parts of isohorone diisocyanate and 500 parts of ethyl acetate were placed in a reaction vessel equipped with a condenser, stirrer and nitrogen inlet tube, and the reaction was performed at 100° C. for 5 hours to obtain "prepolymer 1." The free isocyanate % by weight of "prepolymer 1" was 1.53%.

-Synthesis of Ketimine- 170 parts of isohorone diamine and 75 parts of methyl ethyl ketone were introduced into a reaction vessel equipped with a stirrer and thermometer, and the reaction was performed at 50° C. for 5 hours to obtain "ketimine compound 1." The amine value of "ketimine compound 1" was 418.

-Synthesis of Masterbatch- 1200 parts of water, 540 parts of carbon black (Printex 35, Degussa AG) [DBP oil absorption amount=42 ml/100 mg, pH=9.5] and 1200 parts of polyester resin were added and mixed in a Henschel mixer (Mitsui Mining), then the mixture was kneaded at 150° C. for 30 minutes using two rollers, extrusion cooled and crushed with a pulverizer to obtain "masterbatch 1."

-Manufacture of Oil Phase- 378 parts of "low molecular weight polyester 1," 110 parts of carnauba wax, 22 parts of CCA (salicylic acid metal complex E-84: Orient Chemical Industries) and 947 parts of ethyl acetate were introduced into a vessel equipped with a stirrer and thermometer, the temperature was raised to 80° C. with stirring, maintained at 80° C. for 5 hours, and cooled to 30° C. in 1 hour. Next, 500 parts of "masterbatch 1" and 500 parts of ethyl acetate were introduced into the vessel, and mixed for 1 hour to obtain "initial material solution 1."

1324 parts of "initial material solution 1" were transferred to a vessel, and carbon black and wax were dispersed using a bead mill (ultra bead mill, Imex) under the conditions of liquid feed rate 1 kg/hr, disk circumferential speed of 6 m/sec, 0.5 mm zirconia beads packed to 80% volume % and 3 passes. Next, 1324 parts of a 65% ethyl acetate solution of "low molecular weight polyester 1" was added and dispersed in 1 pass by the bead mill under the aforesaid conditions to obtain "pigment/WAX dispersion 1". The solids concentration of "pigment/WAX dispersion 1" (130° C., 30 minutes) was 50%.

-Emulsification and Solvent Removal- 749 parts of "pigment/WAX dispersion 1," 115 parts of "prepolymer 1" and 2.9 parts of "ketimine compound 1" were placed in a vessel and mixed at 5000 rpm for 1 minute by a TK homomixer (Special Machinery), then 1200 parts of "aqueous phase 1" were added to the vessel and mixed in the TK homomixer at a rotation speed of 13000 rpm for 20 minutes to obtain "emulsion slurry 1."

"Emulsion slurry 1" was placed in a vessel equipped with a stirrer and thermometer, then the solvent was removed at 30° C. for 8 hours and the product was matured at 45° C. for 4 hours to obtain "dispersion slurry 1." In Example B-1, "dispersion slurry 1" had a volume average particle diameter of 5.99 μm and number average particle diameter of 5.70 μm (measured by a Multisizer II).

-Rinsing and Drying-

After filtering 100 parts of "dispersion slurry 1" under reduced pressure, (1): 100 parts of ion exchange water were added to the filter cake, mixed in a TK homomixer (rotation speed 12000 rpm, 10 minutes) and filtered.

(2): 100 parts of 10% sodium hydroxide were added to the filter cake of (1), mixed in a TK homomixer (rotation speed 12000 rpm, and 30 minutes) and filtered under reduced pressure.

(3): 100 parts of 10% hydrochloric acid were added to the filter cake of (2), mixed in a TK homomixer (rotation speed 12000 rpm, 10 minutes) and filtered.

(4): 300 parts of ion exchange water were added to the filter cake of (3), mixed in a TK homomixer (rotation speed 12000 rpm, 10 minutes), and filtered twice to obtain "filter cake 1."

"Filter cake 1" was dried in a circulating air dryer at 45° C. for 48 hours, and sieved through a sieve of 75 μm mesh to obtain "toner 1." The toners have an average particle diameter of 10 μm or less, but if the diameter is too small, it is difficult to control the scattering of toner, so in the present invention, to satisfy high-quality image requirements, toner with an average particle diameter of 4.0 μm to 8.0 μm was used.

In the toner obtained as described above Dv, Dn and the circularity on average were varied, and image-forming tests performed. Dv and Dn were varied by adjusting the dispersion amount of the organic particulate dispersion. Referring to Table 5, as described later, in Examples B-1 to B-8, the ratio (Dv/Dn) was 1.05 to 1.25, and in Comparative Examples B-1 to B-3, the toner did not satisfy the specified range of the present invention. Also, the circularity on average was varied by adjusting the rotation speed of the TK homomixer and solvent removal conditions for preparing the emulsification slurry. Referring to Table 6, as described later, in Examples B-9-16, the circularity was 0.951 to 0.990 on average, and in Comparative Examples B-4 to B-6, the toner did not satisfy the specified range of the present invention.

Regarding the carrier used in Examples Bs, a coating solution comprising 200 parts of silicone resin solution (available from Shin-Etsu Chemicals) and 3 parts of carbon black (available from Cabot Corporation) dissolved in toluene was applied to a ferrite core material by the fluid layer spray method to coat the core material surface, and calcinated in an electric furnace at 300° C. for 2 hours to obtain a silicone resin-coated carrier. Regarding carrier particle diameter, the average particle diameter is preferably 30 μm to 60 μm for which the particle diameter distribution of the toner is relatively sharp, and in the present invention, a carrier having diameter of 40 μm was used.

The above toner and carrier were mixed together to obtain the developer used for image-forming. In this process, the toner concentration was adjusted. The particle diameter distribution of the toner and carrier were measured by a Coulter Counter TAII (Coulter Electronics). The toner weight ratio and charge amount were measured by a blow-off meter at normal temperature and humidity.

[Tests and Evaluation Methods]

Images were evaluated for (1) image quality (image density, high image quality rendition) and (2) abnormal images (image omission at rear end, toner deposition on background of the image due to poor cleaning). This was done by setting the dry double-component developer described earlier in a conventional Ricoh Company, Ltd.'s copier equipped with the developing device (image-developer) of the present invention, and making copies. As copying conditions, an A4 size 6% chart image was passed continuously through the machine, first (A) 100 sheets (indicating the initial period) and then (B) 5000 sheets (indicating change with time). After (A) and (B), copies made after about every 10 sheets with various image patterns were taken as samples. The test images were (1) solid images and solid cross images for evaluating image quality, and (2) grid patterns for evaluating abnormal images (image omission at rear end). Based on this, (1) three levels were defined for the test criteria of (2), i.e., ○, Δ, and x. ○ means satisfactory results with no problem for both (1) image quality and (2) abnormal images, Δ means unsatisfactory results for (1) image quality and (2) abnormal images, but not so much as to cause a problem, and x means unsatisfactory results for both (1) image quality and (2) abnormal images to the extent of causing a problem. In this test, ○ and Δ were determined as "acceptable," and x was determined as "unacceptable."

The tests were conducted in the following manner:

(1) Particle Diameter

The particle size was measured with an aperture diameter of 100 micrometer using a Coulter Electronics particle diameter meter "Coulter Counter TAIL." The volume average particle diameter Dv and number average particle diameter Dn were found by the above particle diameter meter.

(2) Circularity on Average

This was measured as a circularity on average by a flow meter particle image analyzer FPIA-2100 (Toa Medical Electronics). Specifically, the measurement was performed by adding 0.1 ml to 0.5 ml of an alkylbenzene sulfonate surfactant as a dispersing agent to 100 ml to 150 ml of water from which solid impurities in the container had been previously removed, and then adding approximately 0.1 g to 0.5 g of the measurement sample. The suspension in which the sample was dispersed was subjected to dispersion treatment for approximately 1 to 3 minutes by an ultrasonic disperser, and the toner formation was measured by the above apparatus at a dispersion concentration of 3000 to 10000 number/μl.

(3) Image Quality

Image density and high image quality were evaluated. For image quality, the image density of a fill image was measured by an X-Rite (X-Rite). Measurements were taken at 5 points for each color, and the average for each color was calculated. For high image quality, the stability level of "fine horizontal line" developing and dot reproducibility for a fill cross image on paper passed through the apparatus was visually evaluated.

(4) Abnormal Images (Image Omission at Rear End, Background Deposition)

Image omission at rear end and the image deterioration level due to toner deposition on background of the image were visually determined for a grid image on paper passed through the apparatus.

The effect of the present invention will now be described using the actual test results shown in Table 5 and Table 6. First, Table 5 shows the relation between the ratio (Dv/Dn) of the initial toner, image density and abnormal images. It should be noted that, regarding (A), the initial evaluation, both image quality and abnormal images are at a satisfactory level, and as they do not directly show the effect of the present invention which is to resolve the deterioration of the obtained image with time, only (B), evaluation as to with time (after passing 5000 sheets of paper) test results are shown. From the results shown in Table 5, both image quality and suppression of abnormal images are acceptable (○, Δ) when the ratio (Dv/Dn) is 1.05 to 1.25.

TABLE 5

| | Ratio (Dv/Dn) | Circularity on average | Image quality | Abnormal images |
|---|---|---|---|---|
| Comp. Ex. B-1 | 1.04 | 0.991 | ○ | X |
| Example B-1 | 1.05 | 0.976 | ○ | Δ |
| Example B-2 | 1.07 | 0.982 | ○ | ○ |
| Example B-3 | 1.09 | 0.986 | ○ | ○ |
| Example B-4 | 1.14 | 0.973 | ○ | ○ |
| Example B-5 | 1.19 | 0.968 | ○ | ○ |
| Example B-6 | 1.21 | 0.959 | ○ | ○ |
| Example B-7 | 1.24 | 0.950 | ○ | ○ |
| Example B-8 | 1.25 | 0.956 | Δ | ○ |
| Comp. Ex. B-2 | 1.26 | 0.948 | X | Δ |
| Comp. Ex. B-3 | 1.29 | 0.936 | X | Δ |

Next, Table 6 shows the relation between the circularity on average of the initial toner, image density and abnormal images. Here also, only (B) test for with time (after passing 5000 sheets of paper) test results are shown. From the results shown in Table 6, both image quality and suppression of abnormal images are acceptable (○, Δ) when the circularity on average is 0.930 to 0.990.

TABLE 6

| | Ratio (Dv/Dn) | Circularity on average | Image quality | Abnormal images |
|---|---|---|---|---|
| Comp. Ex. B-4 | 1.17 | 0.929 | X | X |
| Example B-9 | 1.23 | 0.931 | Δ | Δ |
| Example B-10 | 1.18 | 0.954 | ○ | Δ |
| Example B-11 | 1.21 | 0.959 | ○ | ○ |
| Example B-12 | 1.19 | 0.968 | ○ | ○ |
| Example B-13 | 1.14 | 0.973 | ○ | ○ |
| Example B-14 | 1.09 | 0.986 | ○ | ○ |
| Example B-15 | 1.06 | 0.989 | ○ | Δ |
| Example B-16 | 1.11 | 0.990 | ○ | Δ |
| Comp. Ex. B-5 | 1.08 | 0.994 | ○ | X |
| Comp. Ex. B-6 | 1.13 | 0.995 | ○ | X |

From Table 5 and Table 6, it is seen that in order to obtain a high image quality with excellent fine line and dot reproducibility without image omission at rear end and toner deposition on background of the image even with time, the conditions that the ratio (Dv/Dn) is 1.05 to 1.25, and that circularity is 0.930 to 0.990 on average must both be simultaneously satisfied.

In the image-forming process according to the aforesaid preferred aspects of the present invention, by developing with a developing device (image-developer) wherein the developer is attracted onto the development sleeve, a magnetic brush is formed on the development sleeve, and the developer is contacted or contacted onto a latent image-bearing member to render a latent image visible, the magnetic brush forms a uniform brush in the longitudinal direction of the development sleeve which comes in contact with the latent image-bearing member. Hence, a uniform, sharp particle size distribution can be maintained over long periods even if high stress is given on the developer with time, and as a result, charging properties are stabilized, and a high image quality with excellent fine line and dot reproducibility without any abnormal images such as image omission at rear end, is continuously obtained over long periods.

Further, in an image-forming apparatus and color image-forming apparatus using this image-forming process, identical results to the above are obtained, so soiling due to scatter of toner inside and outside the apparatus accompanying toner deterioration with time can be prevented, and image quality deterioration due to color mixing can be prevented.

What is claimed is:

1. A double-component developer comprising:

a base of toner particle; and a magnetic resin carrier, wherein the base of toner particle comprises a modified polyester resin (i) as a toner binder resin, wherein a plurality of the base of toner particle has a volume average particle diameter (Dv) of 3 μm to 7 μm, a ratio (Dv/Dn) of the volume average particle diameter (Dv) to a number average particle diameter (Dn) is 1.01 to 1.25, a plurality of the base of toner particle comprises 15% by number or less of the base of toner particle having a particle diameter of 0.6 μm to 2.0 μm, and a plurality of the base of toner particle has a circularity of 0.94 to 0.99 on average.

2. The double-component developer according to claim 1, wherein the composition of the base of toner particle is 1 part by weight to 10 parts by weight of a plurality of the base of toner particle with respect to 100 parts by weight of the magnetic resin carrier.

3. A double-component developer, comprising:

a toner for developing a latent electrostatic image, and a magnetic resin carrier, wherein the toner for developing a latent electrostatic image comprises:

a base of toner particle; and an external additive, wherein the base of toner particle comprises a modified polyester resin (i) as a toner binder resin, wherein a plurality of the base of toner particle has a volume average particle diameter (Dv) of 3 μm to 7 μm, a ratio (Dv/Dn) of the volume average particle diameter (Dv) to a number average particle diameter (Dn) is 1.01 to 1.25, a plurality of the base of toner particle comprises 15% by number or less of the base of toner particle having a particle diameter of 0.6 μm to 2.0 μm, and a plurality of the base of toner particle has a circularity of 0.94 to 0.99 on average, and wherein the composition of the external additive is 0.3 parts by weight to 5.0 parts by weight with respect to 100 parts by weight of a plurality of the base of the toner particle.

4. The double-component developer according to claim 3, wherein the external additive has a specific surface area measured by the BET method of 20 $m^2/g$ to 500 $m^2/g$.

5. A method for manufacturing a base of toner particle, comprising a step of mechanically mixing a toner binder resin comprising a modified polyester resin, a charge controlling substance, and a coloring agent, wherein the base of toner particle comprises a modified polyester resin (i) as a toner binder resin, and wherein a plurality of the base of toner particle has a volume average particle diameter (Dv) of 3 μm to 7 μm, a ratio (Dv/Dn) of the volume average particle diameter (Dv) to a number average particle diameter (Dn) is 1.01 to 1.25, a plurality of the base of toner particle comprises 15% by number or less of the base of toner particle having a particle diameter of 0.6 μm to 2.0 μm, and a plurality of the base of toner particle has a circularity of 0.94 to 0.99 on average.

6. The method for manufacturing a base of toner particle according to claim 5, wherein the coloring agent is mixed as a masterbatch which has been complexed with a resin.

7. The double-component developer of claim 1, wherein the plurality of the base of toner particle has a circularity of 0.966 to 0.99 on average.

8. The double-component developer of claim 3, wherein the plurality of the base of toner particle has a circularity of 0.966 to 0.99 on average.

9. The method of claim 5, wherein the plurality of the base of toner particle has a circularity of 0.966 to 0.99 on average.

* * * * *